US011859932B1

(12) United States Patent
Kras

(10) Patent No.: US 11,859,932 B1
(45) Date of Patent: Jan. 2, 2024

(54) MACHINE GUN SUPPRESSOR

(71) Applicant: Sig Sauer, Inc., Newington, NH (US)

(72) Inventor: Krzysztof J. Kras, Fremont, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/851,346

(22) Filed: Jun. 28, 2022

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS

| | | | | |
|---|---|---|---|---|
| 748,157 | A | 12/1903 | Bouton | |
| 822,127 | A | 5/1906 | Hufnagel | |
| 916,885 | A * | 3/1909 | Maxim | F41A 21/30 89/14.4 |
| 1,000,702 | A | 8/1911 | Thurler | |
| 1,111,202 | A * | 9/1914 | Westfall | F41A 21/30 89/14.4 |
| 1,341,363 | A | 5/1920 | Fiala | |
| 1,427,802 | A | 9/1922 | Goodwin | |
| 1,462,158 | A | 7/1923 | Wildner | |
| 1,736,319 | A | 11/1929 | Maxim | |
| 1,773,443 | A | 8/1930 | Wilman | |
| 2,101,849 | A | 12/1937 | Green | |
| 2,150,161 | A | 3/1939 | Green | |
| 2,165,457 | A | 7/1939 | Cutts, Jr. | |
| 2,351,037 | A | 6/1944 | Green | |
| 2,468,926 | A | 5/1949 | Garrett | |
| 2,514,996 | A | 7/1950 | Faust, Jr. | |
| 3,368,453 | A | 2/1968 | Shaw | |
| 3,385,164 | A | 5/1968 | Walther et al. | |
| 3,667,570 | A | 6/1972 | WerBell, III | |
| 3,693,750 | A | 9/1972 | Takkunen | |
| 3,786,895 | A * | 1/1974 | Perrine | F01N 13/0097 89/14.4 |

(Continued)

FOREIGN PATENT DOCUMENTS

| | | |
|---|---|---|
| EP | 1 764 577 A1 | 3/2007 |
| GB | 743111 | 1/1956 |

(Continued)

OTHER PUBLICATIONS

United States Patent and Trademark Office, Non-Final Office Action issued in U.S. Appl. No. 17/399,337 (dated Nov. 3, 2022).

(Continued)

*Primary Examiner* — Joshua E Freeman
*Assistant Examiner* — Benjamin S Gomberg
(74) *Attorney, Agent, or Firm* — Finch & Maloney PLLC

(57) ABSTRACT

A suppressor for a firearm includes a baffle stack having an outer surface, the baffle stack comprising a plurality of baffles that define an inner chamber extending along a central axis of the baffle stack and a projectile pathway through the baffle stack along the central axis. An outer housing is around the baffle stack and defines an outer volume between the outer housing and the baffle stack. Structures and openings in the suppressor promote a sinuous gas flow path through the inner chamber that enhances turbulent flow within the suppressor and reduces backpressure as desirable when used with a machine gun.

20 Claims, 9 Drawing Sheets

(56) References Cited

U.S. PATENT DOCUMENTS 4,291,610 A 9/1981 Waiser
4,454,798 A 6/1984 Shea et al.
4,482,027 A 11/1984 Gould
4,501,189 A 2/1985 Brandl et al.
4,510,843 A 4/1985 Rabatin
4,530,417 A 7/1985 Daniel
4,576,083 A * 3/1986 Seberger, Jr. ..... F01N 1/08 89/14.4
4,583,445 A 4/1986 Blair
4,588,043 A * 5/1986 Finn ..... F41A 21/30 89/14.4
4,907,488 A 3/1990 Seberger
4,930,396 A 6/1990 Johnson
4,946,105 A 8/1990 Pane, Jr. et al.
4,974,489 A 12/1990 Fishbaugh
5,010,676 A 4/1991 Kennedy
5,029,512 A 7/1991 Latka
5,036,747 A 8/1991 McClain, III
5,078,043 A 1/1992 Stephens
5,092,223 A 3/1992 Hudson
5,136,924 A 8/1992 Foerster et al.
5,164,535 A 11/1992 Leasure
5,425,299 A 6/1995 Teetzel
5,433,133 A 7/1995 La France
5,486,425 A 1/1996 Seibert
5,590,484 A 1/1997 Mooney et al.
5,656,166 A 8/1997 Linnersten et al.
5,661,255 A 8/1997 Webb, III
5,679,916 A 10/1997 Weichert
5,698,810 A 12/1997 Rose
5,777,258 A 7/1998 Soon
5,952,625 A 9/1999 Huff
6,079,311 A 6/2000 O'Quinn et al.
6,298,764 B1 10/2001 Sherman et al.
6,308,609 B1 * 10/2001 Davies ..... F41A 21/30 89/14.4
6,374,718 B1 4/2002 Rescigno et al.
6,376,565 B1 4/2002 Dyer et al.
6,425,310 B1 7/2002 Champion
6,490,822 B1 12/2002 Swan
6,499,245 B1 12/2002 Swan
6,575,074 B1 6/2003 Gaddini
6,732,628 B1 5/2004 Coburn et al.
6,792,711 B2 9/2004 Battaglia
6,796,214 B2 9/2004 Hausken et al.
6,959,509 B2 11/2005 Vais
7,000,547 B2 2/2006 Amick
7,036,259 B2 5/2006 Beretta
7,059,233 B2 6/2006 Amick
7,131,228 B2 11/2006 Hochstrate et al.
7,207,258 B1 4/2007 Scanlon
7,216,451 B1 5/2007 Troy
7,237,467 B1 7/2007 Melton
7,308,967 B1 12/2007 Hoel
7,325,474 B2 2/2008 Yoshimura et al.
7,353,740 B1 4/2008 Hoffman
7,412,917 B2 8/2008 Vais
7,587,969 B2 9/2009 Silvers
7,610,710 B2 11/2009 Brittingham
7,661,349 B1 2/2010 Brittingham
7,676,976 B2 3/2010 Dueck et al.
7,707,762 B1 5/2010 Swan
7,789,008 B2 9/2010 Petersen
7,823,314 B1 11/2010 Wheatley
7,832,323 B1 11/2010 Davies
7,836,809 B2 11/2010 Noveske
7,870,815 B2 1/2011 Hung
7,905,319 B2 3/2011 Sullivan
7,987,944 B1 * 8/2011 Brittingham ..... F41A 21/30 89/14.4
8,100,224 B1 * 1/2012 Olson ..... F41A 21/30 181/267
8,167,084 B1 5/2012 Moore
8,196,701 B1 6/2012 Oliver
8,286,750 B1 10/2012 Oliver
8,307,946 B1 11/2012 Johnston
8,490,535 B1 7/2013 Moore et al.
8,516,941 B1 8/2013 Oliver
8,522,662 B2 9/2013 Presz, Jr. et al.
8,579,075 B2 11/2013 Brittingham et al.
8,671,818 B1 3/2014 Bliver
8,790,434 B1 7/2014 Oliver
8,826,793 B2 9/2014 Oliver
8,844,422 B1 9/2014 Klett
8,875,612 B1 11/2014 Klett et al.
8,973,481 B2 * 3/2015 Dueck ..... F41A 21/30 89/14.4
9,052,152 B2 6/2015 Moss et al.
9,163,891 B1 10/2015 Dater et al.
9,175,920 B2 11/2015 Moore
9,194,640 B2 11/2015 Wirth et al.
9,207,033 B2 12/2015 Nais
9,239,201 B1 * 1/2016 Reis Green ..... F41A 21/30
9,316,456 B1 4/2016 Oliver
9,347,727 B1 5/2016 Cler
9,410,761 B2 8/2016 Morris et al.
9,423,198 B1 8/2016 Oliver
9,435,600 B2 9/2016 Oliver
9,482,484 B2 11/2016 Barney
9,500,427 B1 * 11/2016 Larue ..... F41A 21/30
9,709,354 B2 7/2017 Larue
9,835,399 B1 12/2017 Lessard
10,024,617 B1 7/2018 Moore et al.
10,030,929 B1 7/2018 Lessard
10,126,084 B1 11/2018 Oglesby
10,228,210 B2 3/2019 Parker
10,234,231 B2 3/2019 Gianelloni, III et al.
10,254,068 B2 4/2019 Piemme et al.
10,267,586 B1 * 4/2019 Marfione ..... F41A 21/30
10,371,476 B1 8/2019 Oglesby
10,393,463 B1 8/2019 Sanders et al.
10,415,917 B2 9/2019 White
10,458,739 B2 * 10/2019 Smith ..... F41A 21/30
10,480,883 B2 11/2019 Smith
10,480,888 B2 11/2019 Barrett
10,502,512 B1 * 12/2019 Beaudry ..... F41A 21/28
10,502,513 B2 12/2019 Ellison et al.
10,533,819 B2 1/2020 Thomas
10,634,445 B1 4/2020 Klett
10,648,756 B2 5/2020 Mooty
10,655,926 B2 5/2020 Young et al.
10,724,817 B2 * 7/2020 Miele ..... F41A 21/30
10,746,491 B2 8/2020 Garst et al.
10,753,699 B2 8/2020 Klett et al.
10,690,432 B2 9/2020 Campbell et al.
10,890,403 B2 1/2021 Petersen
10,890,404 B2 1/2021 Petersen
11,493,298 B2 * 11/2022 Magee ..... F41A 21/30
11,585,623 B2 * 2/2023 Borunsky ..... F41A 21/30
11,668,541 B2 * 6/2023 Grob ..... F41A 21/30 89/14.4
2007/0107590 A1 5/2007 Silvers
2007/0107982 A1 5/2007 Sullivan
2007/0256347 A1 11/2007 Fitzpatrick et al.
2009/0200105 A1 8/2009 Geyer, III
2009/0235568 A1 9/2009 Auvine
2010/0048752 A1 2/2010 Vignola et al.
2010/0163336 A1 7/2010 Presz, Jr. et al.
2010/0199834 A1 8/2010 Dueck et al.
2011/0067950 A1 3/2011 Shults et al.
2014/0035076 A1 2/2014 Zhang et al.
2014/0224574 A1 * 8/2014 Latka ..... F41A 21/30 181/223
2014/0262605 A1 9/2014 Washburn, III et al.
2014/0353076 A1 12/2014 Bethlenfalvy
2014/0360807 A1 12/2014 McKenzie
2015/0136519 A1 5/2015 Moore
2015/0253099 A1 9/2015 Shults
2015/0260472 A1 9/2015 Smith
2016/0084602 A1 3/2016 Smith
2016/0109205 A1 4/2016 Coppinger et al.
2016/0238335 A1 8/2016 Bertschinger et al.
2017/0160034 A1 * 6/2017 Parker ..... F41A 21/30

(56) References Cited

U.S. PATENT DOCUMENTS

| | | | | |
|---|---|---|---|---|
| 2017/0299314 | A1 | 10/2017 | Palu | |
| 2017/0321984 | A1 | 11/2017 | Palu et al. | |
| 2018/0135932 | A1* | 5/2018 | Tomczak | F41A 21/30 |
| 2018/0252489 | A1* | 9/2018 | Parker | F41A 21/30 |
| 2018/0313626 | A1 | 11/2018 | Tomczak | |
| 2018/0313627 | A1 | 11/2018 | Tomczak | |
| 2018/0340750 | A1 | 11/2018 | Mooty | |
| 2019/0257607 | A1 | 8/2019 | Dobrinescu | |
| 2020/0025491 | A1* | 1/2020 | Petersen | B33Y 80/00 |
| 2020/0025494 | A1* | 1/2020 | Parker | F41A 21/30 |
| 2020/0064099 | A1 | 2/2020 | Young et al. | |
| 2020/0096279 | A1 | 3/2020 | Hibbitts et al. | |
| 2020/0116450 | A1 | 4/2020 | Ellison et al. | |
| 2020/0224989 | A1 | 7/2020 | Bundy et al. | |
| 2020/0232741 | A1* | 7/2020 | Hood, II | F41A 21/30 |
| 2020/0240737 | A1 | 7/2020 | Wheeler et al. | |
| 2020/0263947 | A1 | 8/2020 | Calderwood et al. | |
| 2021/0003360 | A1 | 1/2021 | Kras | |
| 2021/0041200 | A1* | 2/2021 | Kras | F41A 21/30 |
| 2021/0071979 | A1 | 3/2021 | Plunkett, Jr. et al. | |

FOREIGN PATENT DOCUMENTS

| | | | |
|---|---|---|---|
| GB | 2 288 007 | A | 4/1995 |
| GB | 2 287 780 | A | 9/1995 |
| WO | 9902826 | | 1/1999 |
| WO | 2015016998 | A2 | 2/2015 |
| WO | 2020081268 | A2 | 4/2020 |

OTHER PUBLICATIONS

Volk, Oleg, AllOutdoor.com, "Thermal Defense Solutions: 3D-Printed Inconel Sound Suppresors" available at https://www.alloutdoor.com/2018/04/03/thermal-defense-solutions-3d-printed-steel-sound-suppressors/ (Apr. 3, 2018).

OSS Suppressors.com Website, RAD 22 Suppressor, https://osssuppressors.com/suppressors/rimfire/ (visited Apr. 29, 2019).

RetroRifles.com Website, M16A1 Birdcage Flash Hider, https://retrorifles.com/m16a1-birdcage-flash-hider-4-options/ (last visited Dec. 17, 2019).

Operators Suppressor Systems Info Sheet (2015).

* cited by examiner

MACHINE GUN SUPPRESSOR

FIELD OF THE DISCLOSURE

This disclosure relates generally to muzzle accessories for use with firearms and more particularly to a suppressor particularly suited for use with a machine gun.

BACKGROUND

Firearm design involves many non-trivial challenges. For example, rifles, machine guns, and other firearms have faced particular complications with reducing the audible and visible signature produced upon firing a round, while also maintaining the desired shooting performance. A suppressor is a muzzle accessory that reduces the audible report of the firearm by slowing the expansion and release of pressurized gases from the barrel. Visible flash can also be reduced by controlling the expansion of gases leaving the barrel as well as by controlling how muzzle gasses mix with ambient air.

Figure 1:
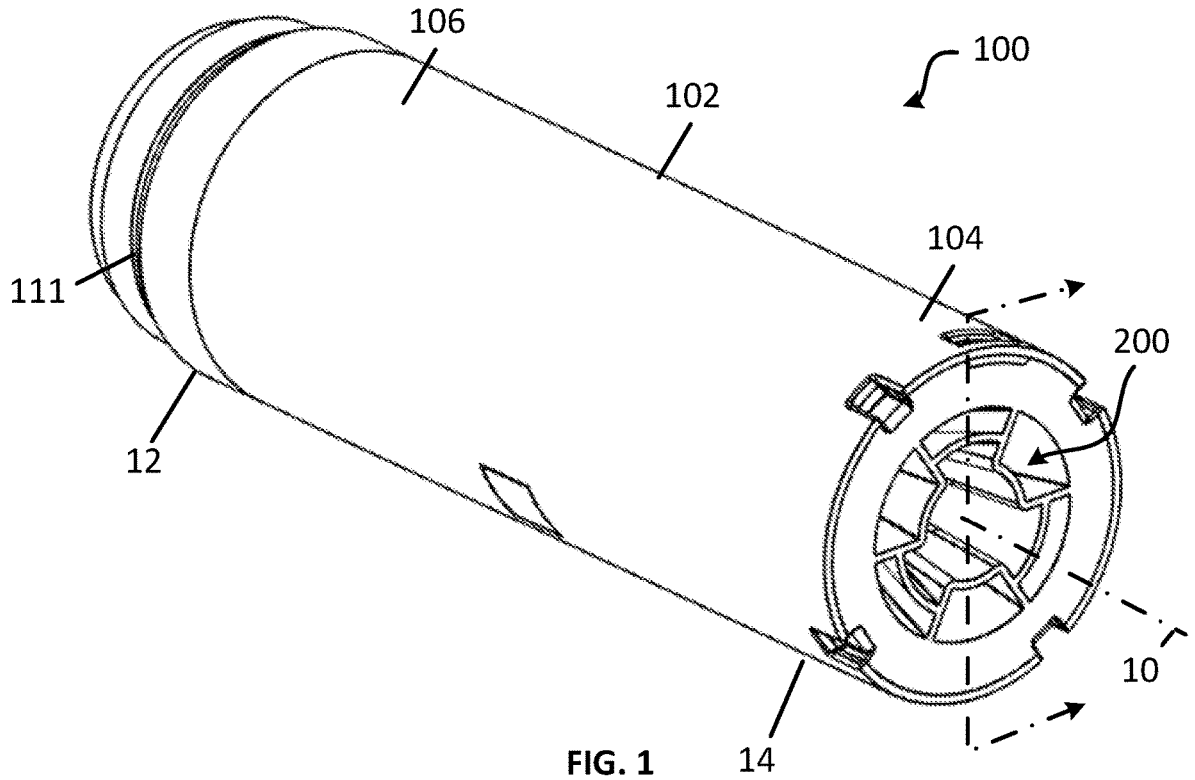
FIG. 1 illustrates a front perspective view of a suppressor, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed herein is a suppressor assembly having reduced gas back flow and a suppressor baffle for use in a suppressor assembly, in accordance with some embodiments of the present disclosure. In one example, a suppressor includes a baffle stack coaxially arranged within an outer housing, which can be cylindrical. The baffle stack has a plurality of generally conical or cone-like baffle structures connected to a baffle stack wall, which can also be cylindrical. The region within the baffle stack wall defines an inner volume that includes the path of the projectile through central openings of each baffle structure. An outer volume is defined between the baffle stack wall and the outer housing, such that the outer volume is concentric with and positioned radially outside of the inner chamber.

Individual baffle structures taper proximally from the baffle stack wall to a central opening on the bore axis. At least some of the baffle structures define a through-opening located between the central opening and the baffle stack wall, providing an alternate flow path from baffle to baffle for gases in a radially outer region of the inner chamber. A conduit wall extends between and connects adjacent baffle structures so as to define a gas flow pathway in a radially outer portion of the inner volume. For example, the gas flow pathway passes around a proximal one of the adjacent baffle structures and through the opening defined in a distal one of the adjacent baffle structures. Conduits between adjacent baffle structures can be arranged in alternating sides of the inner chamber to promote a sinuous gas flow path.

Flow-directing structures in the outer volume may include pairs of diverging vanes and pairs of converging vanes with respect to gases flowing distally through the suppressor. These flow-directing structures can promote gas flow between the inner chamber and outer volumes by creating localized regions of reduced or increased pressure. For example, converging vanes adjacent the proximal end of the baffle stack can direct gases from the outer volume into the inner chamber with a flow direction that crosses the bore axis. Pairs of diverging vanes can promote gas flow from the inner volume to the outer volume via ports defined in the baffle stack wall.

In some embodiments, the suppressor can include an integrated flash hider in the distal end of the suppressor assembly to reduce the visible signature. In one example, the flash hider includes a first flash hider portion and a second flash hider portion. The first flash hider portion vents gases directly from the inner volume, such as gases flowing along the bore axis. The second flash hider portion is located radially outside of the first flash hider portion and can be configured to vent gases directly from the outer volume, from the inner volume, or both. In some embodiments, the flash hider includes a third flash hider portion arranged to vent gases directly from the outer volume in parallel with gases venting from the inner volume. In one example, the third flash hider portion includes ports distributed around a radially outer portion of the endcap that vent gases directly from the outer volume.

When the firearm is discharged, the projectile travels through the suppressor along the bore axis, followed by combustion gases. Gases initially expand in a blast chamber in the proximal end portion of the suppressor. A first portion of combustion gases continues along the bore axis and enters the baffle stack through a central opening in the first baffle, sometimes referred to as the blast baffle. A second portion of combustion gases flows into the outer chamber between the baffle stack and outer housing. The second portion of gases may include gases deflected outward from the central axis in the blast chamber, for example. Gases in the outer chamber are largely isolated from and can vent semi-independently of gases flowing through the inner chamber.

To more evenly fill the suppressor and to promote gas flow through most of the suppressor volume, some gases can be directed across the bore axis to create a sinuous flow. This elongated flow path delays the exit of gases from the inner chamber, which effectively reduces sound signature. In one embodiment, combustion gases are generally directed in an off-axis direction through the baffle stack as a result of one or more features. A baffle structure can have a central opening that is shaped to promote off-axis flow through the central opening. The central opening to the generally-conical baffle structure can have a step, an offset, a notch, or otherwise can define a non-circular opening, for example, to promote gas flow through the opening in a direction transverse to the central axis. In one such embodiment, the central opening is circular as viewed along the central axis, and has a first half of the opening that is axially offset from an opposite second half of the opening so as to provide an enlarged area as viewed transversely through the opening.

Ports along the baffle stack wall direct gases from the inner chamber to the outer chamber, or vice versa. For example, the baffle stack can define ports so that gases near the radially outer portion of a baffle structure can pass into the outer chamber rather than stalling at a dead end between the cone and the outer wall of the baffle stack. Also, gases in a radially outer portion of the inner chamber can pass from one baffle to the next baffle via a conduit that extends between openings in the cone-like baffle structures. When used alone or in combination with other flow-directing features, the baffle stack promotes and/or amplifies a sinuous flow through the inner chamber.

Features of the suppressor can be employed to amplify a sinuous or otherwise off-axis gas flow through the suppressor's inner chamber, a tortuous flow path through the outer chamber, and multiple gas flow paths through the flash hider. Various features can be used individually or in combination to provide suitable attenuation of the audible signature, attenuation of the visible signature, and reduction in back flow of pressurized gases into the firearm's receiver, particularly with some suppressors having an overall diameter of greater than two inches. Numerous variations and embodiments will be apparent in light of the present disclosure.

General Overview

As noted above, non-trivial issues may arise that complicate weapons design and performance of firearms. For instance, one non-trivial issue pertains to the fact that the discharge of a firearm normally produces an audible and visible signature resulting from rapidly expanding propellant gases and from the projectile leaving the muzzle at a velocity greater than the speed of sound. It is generally understood that attenuating the audible report may be accomplished by slowing the rate of expansion of the propellant gases. Reducing the visible signature or visible flash also can be accomplished by controlling the expansion of gases exiting the muzzle. Reducing flash is a function of temperature, pressure, barrel length, and the type of ammunition being fired, among other factors. However, attenuating muzzle flash can adversely affect the performance of sound attenuation and vice versa.

Suppressors can have additional challenges associated with reducing visible flash and attenuating sound. In some suppressor designs, for example, slowing down the expansion and release of combustion gases from the muzzle can undesirably result in trapping and delayed release of pressurized gas from the suppressor, which results in a localized volume of high-pressure gases. As a natural consequence, the pressurized gases within the barrel take the path of least resistance to regions of lower pressure. Such condition is generally not problematic in the case of a bolt-action rifle because the operator opens the bolt to eject the spent casing in a time frame that is much greater than the time required for the gases in the suppressor to disperse through the distal (forward) end of the suppressor. However, in the case of a semi-automatic rifle, automatic rifle, or a machine gun, the bolt opens very quickly after firing (e.g., within 1-10 milliseconds) to reload the firearm for the next shot. In this short time, pressurized gases remain in the suppressor and the barrel. Some of the gases remaining in the barrel and the suppressor therefore follow the path of least resistance through the barrel and out through the chamber towards the operator's face rather than following the tortuous path through the suppressor. To avoid introducing particulates and combustion residue to the chamber, and to avoid combustion gases being directed towards the operator's face, it would be desirable to reduce the pressure build up within the suppressor and therefore reduce or eliminate back flow into the receiver of autoloading firearms.

Thus, reducing the visible signature while also reducing the audible signature of a firearm presents non-trivial challenges. To address these challenges and others, and in accordance with some embodiments, the present disclosure relates to a suppressor having reduced gas back flow, a suppressor baffle for use in a suppressor assembly, and a suppressor with an integrated flash hider.

Compared to traditional baffle-type suppressors, a suppressor of the present disclosure can reduce localized volumes of high-pressure gas and the resulting flow of combustion gases backward through the barrel and into the rifle's receiver after firing, such as may occur in semiautomatic and automatic rifles. The inner and outer chambers divide the gases into inner and outer volumes that can, in some embodiments, better expand to fill and flow through the entire suppressor volume.

A suppressor (or a portion thereof) according to the present disclosure can be manufactured by molding, casting, machining, 3-D printing, or other suitable techniques. For example, additive manufacturing—also referred to as 3-D printing—can facilitate manufacture of complex geometries that would be difficult or impossible to make using conventional machining techniques. One additive manufacturing method is direct metal laser sintering (DMLS).

As will be appreciated in light of this disclosure, and in accordance with some embodiments, a suppressor assembly configured as described herein can be utilized with any of a wide range of firearms, such as, but not limited to, machine guns, semi-automatic rifles, automatic rifles, short-barreled rifles, and submachine guns. Some embodiments of the present disclosure are particularly well suited for use with a belt-fed machine gun. Suitable host firearms and projectile calibers will be apparent in light of this disclosure.

Although generally referred to a suppressor herein for consistency and ease of understanding the present disclosure, the disclosed suppressor is not limited to that specific terminology and alternatively can be referred to as a silencer, sound attenuator, a sound moderator, a signature attenuator, or other terms. Also, although generally referred to herein as a baffle structure, the disclosed baffles are not limited to that specific terminology and alternately can be referred to, for example, as a baffle cone, a tapered wall, or other terminology, even if such structure follows or does not follow a true conical geometry. Further, although generally referred to herein as a flash hider for consistency and ease of understanding the present disclosure, the disclosed flash hider is not limited to that specific terminology and alternatively can be referred to, for example, as a flash suppressor, a flash guard, a suppressor end cap, or other terms. Numerous configurations will be apparent in light of this disclosure.

Example Suppressor Configurations

Figure 2:
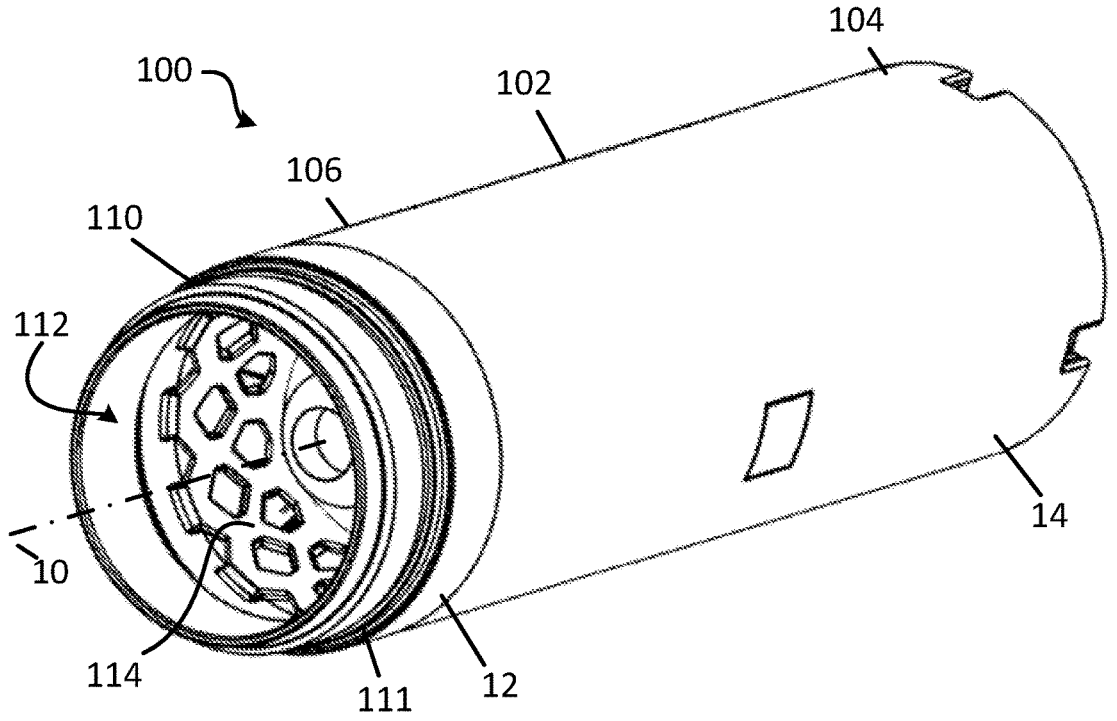
FIG. 2 illustrates a rear perspective view of the suppressor of FIG. 1 and shows a blast chamber in the proximal end portion of the suppressor, in accordance with an embodiment of the present disclosure.

FIGS. 1 and 2 illustrate front and rear perspective views, respectively, of a suppressor assembly 100 (or simply "suppressor" 100), in accordance with an embodiment of the present disclosure. In this example, the suppressor 100 has a cylindrical shape that extends along a bore axis 10 from a proximal end portion 12 to a distal end portion 14. The diameter of the outer housing 102 can be 1.5-3.0 inches in some embodiments, including 1.5-2.0 inches, 2.0-2.5 inches, and 2.5-3.0 inches. The cylindrical shape is not required, and other geometries are acceptable, including a cross-sectional shape that is hexagonal, octagonal, rectangular, oval, or elliptical, for example. An outer housing 102 extends between a distal housing end portion 104 and a proximal housing end portion 106. The proximal housing end portion 106 optionally includes a threaded portion 111 that can be used to connect the suppressor 100 to an adapter or quick-disconnect assembly (not shown) suitable for attachment to a firearm barrel, for example.

A flash hider 200 is retained in the distal end portion 14. The proximal end portion 12 defines a blast chamber 112. As can be seen in FIG. 2, for example, the blast chamber 112 includes a diffusor cone 114 that tapers radially inward as it extends distally to meet the baffle structure 126 of a baffle 122. The diffusor cone 114 defines a plurality of openings. In some embodiments, the blast chamber 112 is sized to accommodate a muzzle brake, flash hider, or similar muzzle attachment on the barrel of the firearm. For example, the suppressor 100 is constructed to be installed over a muzzle attachment on the firearm barrel, where the muzzle attachment is received in the blast chamber 112; however, no such muzzle attachment is required for effective operation of suppressor 100. In one example embodiment, the blast chamber 112 has an axial length from 0.5 inch to about 3 inches. Numerous variations and embodiments will be apparent in light of the present disclosure.

Figure 3:
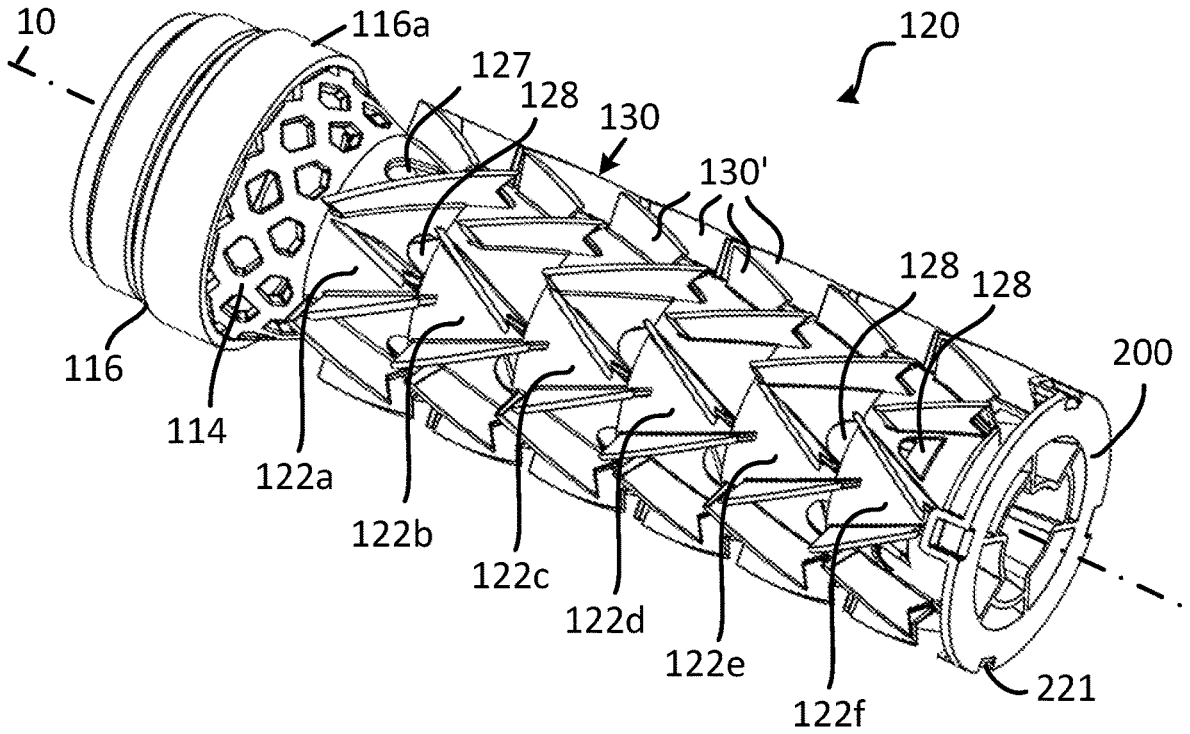
FIG. 3 illustrates a front perspective view of a suppressor shown without the outer housing to expose the baffle stack, flash hider, and diffusor baffle, in accordance with an embodiment of the present disclosure.
Figure 4:
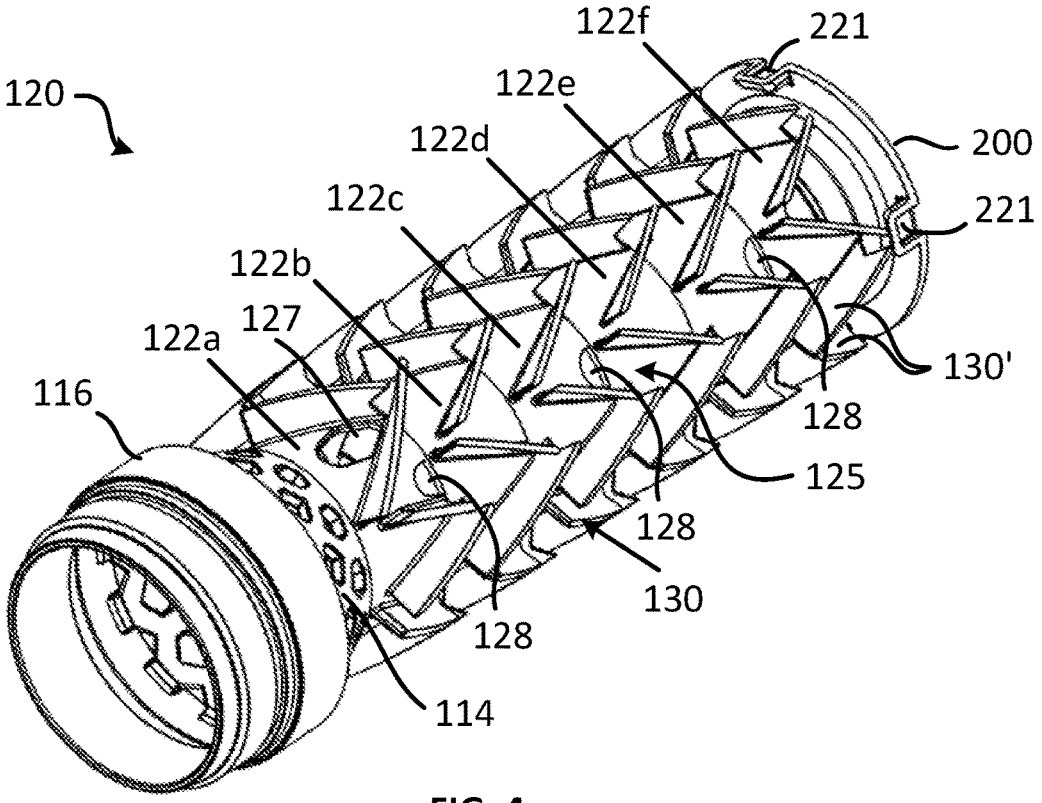
FIG. 4 illustrates a rear perspective view of the baffle stack of FIG. 3.
Figure 5:
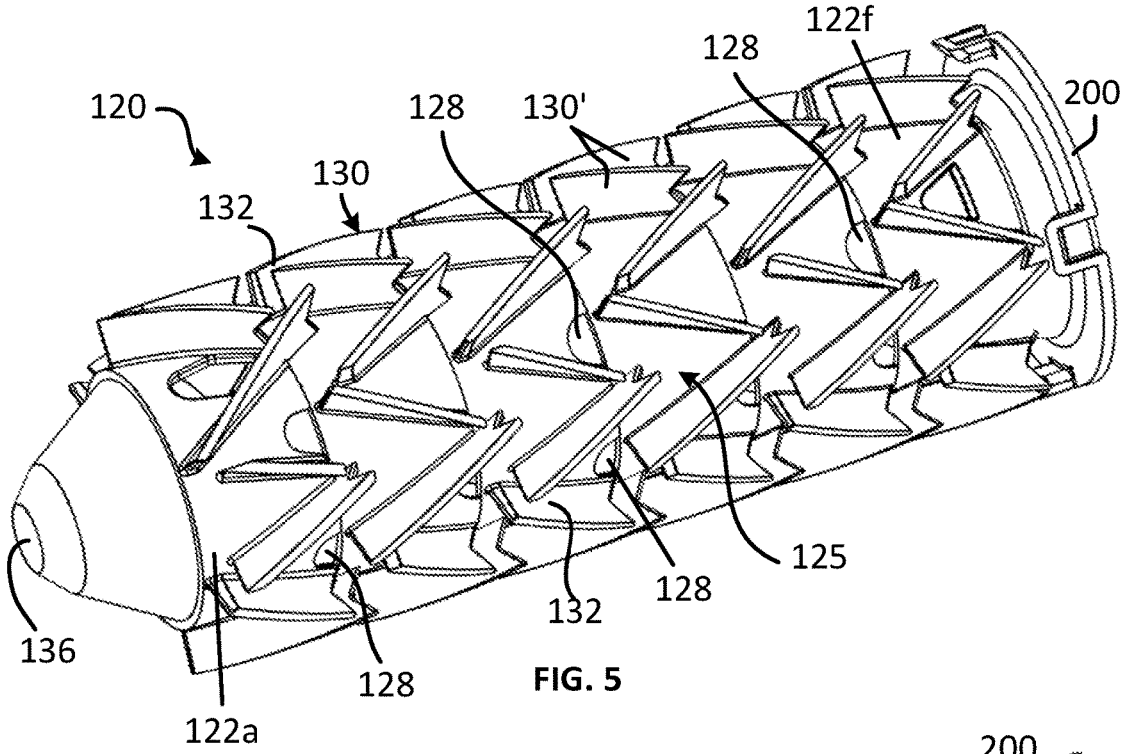
FIG. 5 illustrates a side and rear sectional view of a baffle stack with a flash hider on the distal end, in accordance with an embodiment of the present disclosure
Figure 6:
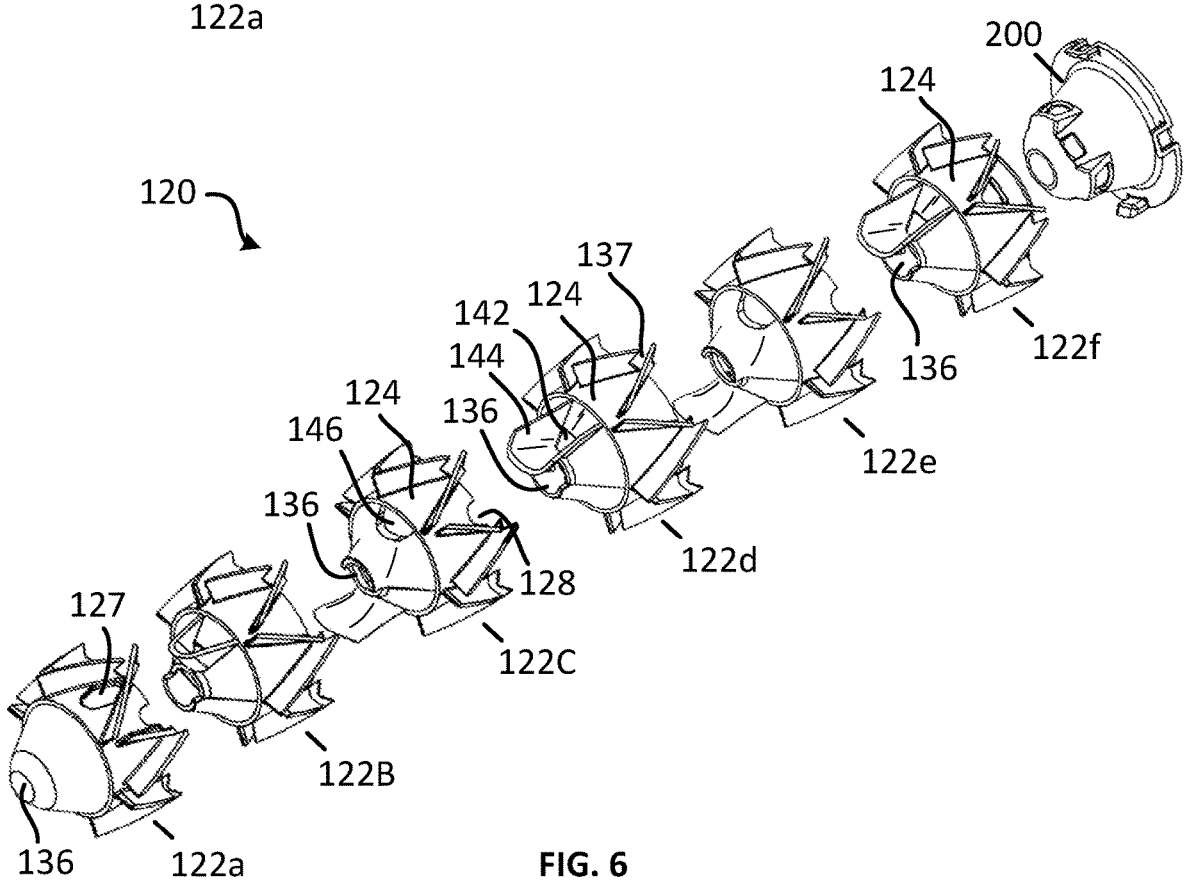
FIG. 6 illustrates an exploded rear perspective view of the baffle stack and flash hider of FIG. 5, in accordance with another embodiment of the present disclosure.
Figure 7A:
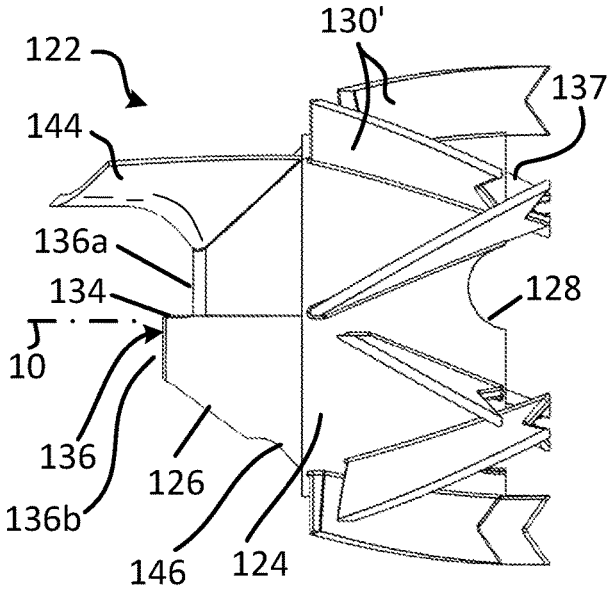
FIGS. 7A-7D illustrate a side view, a bottom view, a top and rear perspective view, and a front perspective view, respectively, of a suppressor baffle, in accordance with an embodiment of the present disclosure.
Figure 7B:
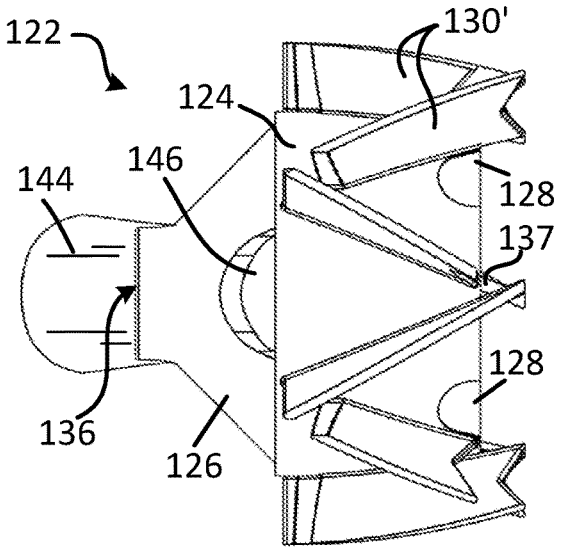
Figure 7C:
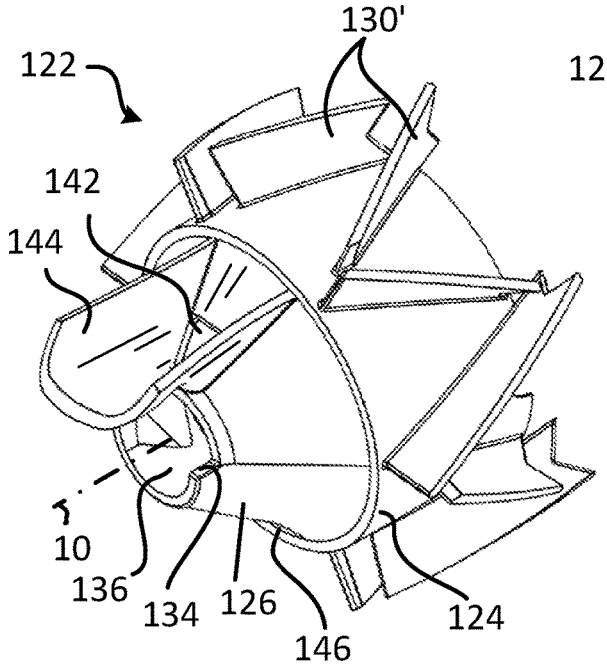
Figure 7D:
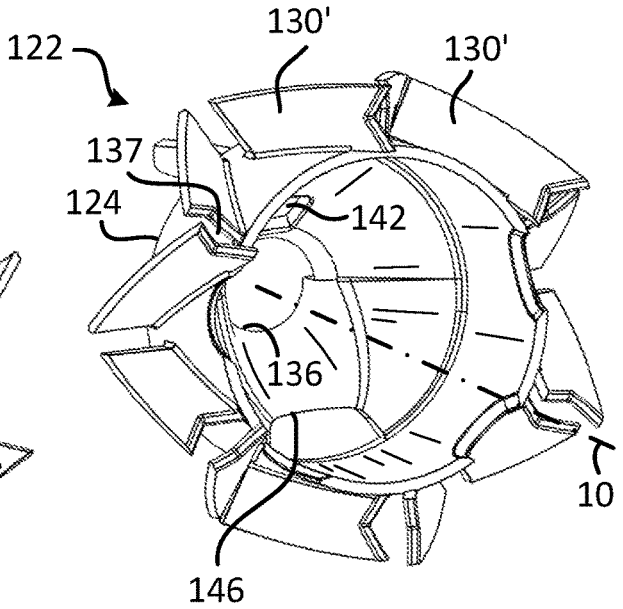

Referring now to FIGS. 3-6, various perspective views show a baffle stack 120 in accordance with the present disclosure. FIG. 3 is a front and side perspective view of a baffle stack 120 with a diffusor cone 114 and flash hider 200. FIG. 4 is a rear and side perspective view of a baffle stack 120 with the diffusor cone 114 and flash hider 200. FIG. 5 is a rear and side perspective view of baffle stack 120 with the flash hider 200. FIG. 6 is an exploded, top and rear perspective view of a baffle stack 120 with flash hider 200.

In some embodiments, the baffle stack 120 has three or more baffles 122 between a flash hider 200 and diffusor cone 114. In the example shown, the baffle stack 120 has six baffles **122*a*-122*f*, where the baffles 122 are arranged sequentially and with the central openings 136 on the central axis or bore axis 10 to define a projectile flow path therethrough. As shown in FIGS. 3-4, a mounting portion 116 with diffusor cone 114 is positioned proximally of the first baffle 122*a*. Note that the mounting portion 116 has a cylindrical portion 116*a* that is generally the same size as the outer housing 102 (shown in FIG. 1). The diffusor cone 114 tapers in size from the inside of the cylindrical portion 116*a* to join the baffle wall segment 124 of the first baffle 122*a*. The diffusor cone 114 defines openings to direct a portion of gases to the outer chamber of the suppressor 100**.

In some embodiments, the baffle stack 120 includes a plurality of individual baffles 122, each of which includes an annular (e.g., cylindrical) baffle wall segment 124 and one or more baffle structures 126 of generally conical shape that are connected to the baffle wall segment 124 and taper to a central opening. Other shapes of the baffle wall are acceptable including a rectangular, hexagonal, octagonal, oval, or other cross-sectional geometry. In other embodiments, the baffle stack 120 can be made as a single component, such as using additive manufacturing.

In embodiments having individual baffles, the baffle wall segments 124 abut or connect to one another to define a tubular baffle stack wall 125. The baffle wall segments 124 can be connected to one another by welding, a threaded interface, or an interference fit, for example. In other embodiments, the entire baffle stack 120, or portions thereof, can be formed as a single monolithic structure. For example, the baffle stack 120 can be made using additive manufacturing techniques such as direct metal laser sintering (DMLS). In embodiments where the baffle stack 120 is a monolithic structure, the baffle stack wall 125 may not distinctly define individual baffle wall segments 124, but the baffle stack 120 can be considered as having baffle portions corresponding to the equivalent structure formed as distinct baffles 122. Principles discussed herein for a baffle stack 120 having distinct baffles 122 apply to a baffle stack 120 formed as a unitary structure and vice versa. The structure of individual baffles 122 is discussed in more detail below.

The baffle stack 120 includes flow-directing structures 130 on the outside of the baffle stack wall 125. In various examples, the flow-directing structures 130 can be connected to one or both of an outer surface of the baffle stack wall 125 and an inner surface of the outer housing 102. The flow-directing structures 130 can be vanes, walls, ridges, partitions, or other obstructions that cause collisions with flowing gases and result in a non-linear gas flow through the outer chamber 109. In some examples, flow-directing structures 130 can include alternating vanes 130' that extend part way the outer housing 102 and the baffle stack wall 125, where the alternating position of the flow-directing structures 130 can define an oscillating flow path for the gases as they flow towards exit at the distal end of the suppressor 100.

In the examples of FIGS. 3-6, the flow-directing structures 130 are configured as vanes 130' having a planar or helical shape. The vanes 130' are on the outside of the baffle stack wall 125 and arranged in a zig-zag or herringbone-type pattern. For example, each baffle wall segment 124 has vanes 130', each of which extends transversely to the bore axis 10 and has an axial length roughly equal to the axial length of the baffle wall segment 124. In some instances, part of a vane 130' may extend beyond the end of the baffle wall segment 124, such as illustrated. Ends of adjacent vanes 130' can be directed towards each another to make a V shape or vertex 132, even though the ends of vanes 130' may or may not close the vertex 132. As shown in this example, vanes 130' define a gap or opening 137 (also shown in FIGS. 7A-7D) at the vertex 132 for gas flow therethrough. Each vertex 132 is positioned to point generally along the bore axis 10 either distally or proximally. In some embodiments, vanes 130' are generally arranged in a circumferential grid with vertices 132 arranged along lines that are parallel to the bore axis 10, and in rows arranged circumferentially around the baffle stack 120. Vanes 130' defining a vertex 132 pointing proximally can be referred to as diverging vanes 130' and vanes 130' defining a vertex 132 pointing distally can be referred to as converging vanes.

In this example, the first baffle 122*a* defines an initial gas port 127 located adjacent the vertex of converging vanes 130' on the first baffle 122*a*. This initial gas port 127 is positioned to amplify the initial phase of a sinuous flow of gases within the inner chamber 108 by directing gases into the inner chamber 108 in a direction that crosses the bore axis 10 (e.g., downward as oriented in FIG. 6). In the examples of FIGS. 3-6, the initial gas port 127 is shown as being on the top side of the baffle stack 120 for ease of discussion. Note, however, that the baffle stack 120 and suppressor 100 are not constrained to any particular rotational orientation and the initial gas port 127 can be on the side, bottom, or other location. When the initial gas port 127 is positioned along the top of the baffle stack 120, for example, it directs gases downward across the bore axis 10 to reinforce or accentuate a sinuous flow pattern that is oriented in a vertical plane; in other rotational orientations of initial gas port 127, the sinuous flow of gases may be similarly rotated about the bore axis 10. Flow of gases through the suppressor 100 is discussed in more detail below.

The baffle stack 120 in the examples of FIGS. 3-6 defines a plurality of additional gas ports 128 each of which is positioned between diverging vanes 130'. The additional gas ports 128 are distributed about the baffle stack wall 125 with at least some of the gas ports 128 being formed at the joint between adjacent baffle wall segments 124. In some embodiments, when the gas port 127 is along the top of the baffle stack 120, additional gas ports 128 are positioned along sides of the baffle stack 120.

The gas ports 128 can be positioned to permit gases to pass between the outer chamber 109 rather than stall in a corner or similar region within the inner chamber 108. In some embodiments, the pressure is greater in the outer chamber 109, resulting in gas ports 128 functioning as inlet ports for gas flow from the outer chamber 109 to the inner chamber 108. Note, however, that gas dynamics within the suppressor 100 depend on many factors and the gas flow through various ports could reverse directions during the firing cycle. For example, gases may flow in either direction between the inner chamber 108 and the outer chamber 109.

The flash hider 200 is installed adjacent the final baffle 122 (baffle 122*f* in this example) with portions of the flash hider 200 received within the baffle wall segment 124. The flash hider 200 can be secured to the baffle stack 120 by welding, threaded engagement, a frictional fit, or other by engagement with the outer housing 102. Optionally, the flash hider 200 defines recesses 221 in the distal end portion to facilitate engagement with a spanner or other tool used to assemble the suppressor 100 with the mount 110, or to screw the suppressor 100 onto the barrel or barrel attachment. Example embodiments of a flash hider 200 are discussed in more detail below.

Referring now to FIGS. 7A-7D, a baffle 122 is illustrated in a side view, a bottom view, a top and rear perspective view, and a front perspective view, respectively, in accordance with an embodiment of the present disclosure. Baffle 122 in this example is also shown as baffle 122*d* in the exploded view of FIG. 6. Baffle 122 has a cylindrical baffle wall segment 124 connected to a generally conical baffle structure 126 that extends rearwardly as it tapers in size from the baffle wall segment 124 to the central opening 136 aligned with the bore axis 10. As noted above, the central opening 136 provides a pathway for a projectile along the bore axis 10. In this example, the baffle structure 126 generally has a frustoconical geometry with a linear taper. In other embodiments, the baffle structure 126 can have a stepped profile or other non-linear taper, as will be appreciated. In other embodiments, the baffle structure 126 can have a polygonal cross-sectional shape, such as a rectangle, hexagon, or star.

In this example, the central opening 136 has a stepped shape (as viewed from the side) such that a step 134 extends horizontally through the center of the central opening 136, dividing the central opening 136 into a first portion 136*a* (e.g., an upper half) and a second portion 136*b* (e.g., a lower half), where the first portion 136*a* is axially offset from the second portion 136*b*. As a result of the step 134, the cross-sectional area of the central opening 136 in the direction of the bore axis is circular, and it is smaller than the cross-sectional area of the opening in an oblique, transverse (e.g., downward) direction. This larger opening allows for less restrictive gas flow in somewhat oblique, transverse direction to the bore axis, thus promoting a sinuous flow path. The cross sectional area of the central opening 136 in the axial direction is circular and smaller than the cross-sectional area in the transverse direction. In one embodiment, gases flow through the central opening 136 in a direction approximately parallel to the wall of the baffle structure 126, such as an angle with the bore axis 10 from 15-60 degrees, including 30-50 degrees, 20-40 degrees, 25-35 degrees, about 30 degrees, about 35 degrees, about 40 degrees, or about 45 degrees.

The step 134 can be formed, for example, by machining away the upper or lower part of the baffle structure 126 at the central opening 136. In other embodiments, the central opening 136 can be bored at an angle with respect to the bore axis 10, such as an angle of 30-60° to result in the central opening 136 having an oval shape. In yet other embodiments, the larger portion 136*a* can have an enlarged cross-sectional area as a result of a crescent-shaped recess added to the bore area, a second bore formed at a downward angle and intersecting the central opening 136 to increase the size of part of the central opening 136, a notch added to the area of the opening, or other approach.

Between the first portion 136*a* of the central opening 136 and the baffle wall segment 124, the baffle structure 126 defines a first through opening 142. Between the second portion 136*b* of the central opening 136 and the baffle wall segment 124, a radially outer portion of the baffle structure 126 defines a second through opening 146. In the example shown, the first through opening 142 and second through opening 146 are oriented 180° from each other on opposite sides of the central opening 136. A conduit 144 or chute extends between adjacent baffle structures 126 and directs a portion of gases through the inner chamber 108 using through openings 142, 146. For example, the conduit 144 extends rearwardly from the outside of one baffle structure 126 to the inside of an adjacent baffle structure 126 while also connecting to the baffle wall segment 124. The second through opening 146 can direct gases into the conduit 144 that leads to the first through opening 142 of a distally located baffle 122. In some embodiments, the second through opening 146 is bounded in part by the baffle wall segment 124.

When baffles 122 configured as shown in the example of FIGS. 7A-7D are assembled sequentially with each baffle being 180° out of phase with the preceding baffle, the conduit 144 of one baffle 122 receives gases from the second through opening 146 of a preceding baffle and delivers those gases to the next baffle via the first through opening 142 of the subsequent baffle. The result is a sinuous gas flow within the inner chamber that crosses the bore axis 10. This sinuous flow pattern can occur along a vertical plane or other plane as desired. Gas ports 128 along the sides of the baffle wall segment 124 direct gases into the outer chamber 109 from radially outer regions along the sides of the inner chamber 108. Sample gas flow paths are discussed in more detail below.

Flow-directing structures 130 configured as vanes 130' are on the outside of the baffle wall segment 124. Vanes 130' are arranged in a zig-zag pattern moving circumferentially around the baffle wall segment 124. As a result, circumferentially adjacent vanes 130' have either a diverging or converging arrangement, where the vertex 132 of each pair of vanes 130' is directed along the bore axis 10. In this example, the vanes 130' defining each vertex 132 do not make contact (or do not make complete contact) so as to define an opening 137 between ends of the converging vanes 130' and to permit gases to flow through the vertex 132. In some embodiments, the distal ends of each vane 130' has a V-shaped notch while the proximal end of the vane 130' is substantially straight. In some embodiments, each vertex 132 can have an opening 137 of the same or different size compared to other vertices 132. Also, openings between diverging vanes 130' or converging vanes 130' can be of the same or different size and geometry. Numerous variations and embodiments will be apparent in light of the present disclosure.

The baffle wall segment 124 can define one or more gas ports 128 positioned between diverging vanes 130'. When the gas port 127 is along the top of the baffle stack 120, such as shown in FIG. 5, gas ports 128 are positioned along the sides of the baffle wall segment 124. Gas ports 128 in this example have a semicircular shape, but other shapes are acceptable. Optionally, the baffle wall segment 124 can define gas ports in various other locations. Further, a radially outer portion of a given baffle structure 126 may define one or more through openings 142, 146 that permit passage of gases within the inner chamber 108, such as gases moving between adjacent baffle structures 126.

Figure 8:
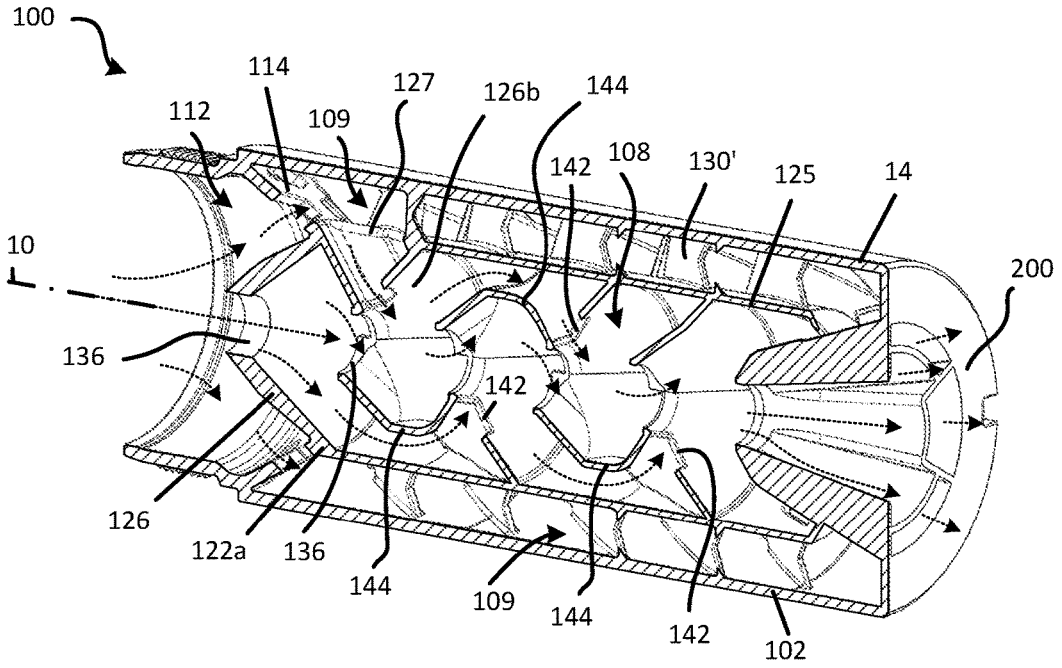
FIG. 8 illustrates a front perspective view showing a longitudinal section of a suppressor, in accordance with an embodiment of the present disclosure.
Figure 9:
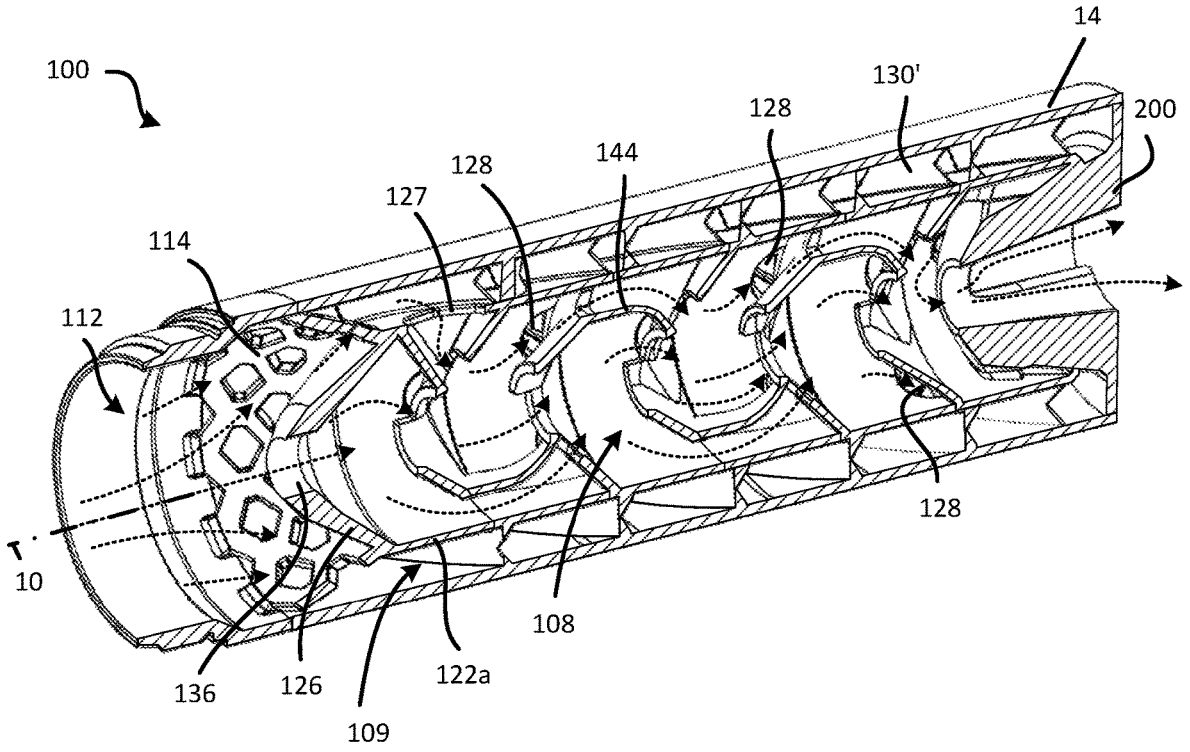
FIG. 9 illustrates a rear perspective view showing a longitudinal section of a suppressor, in accordance with an embodiment of the present disclosure.

Referring now to FIGS. 8 and 9, a front perspective view and a front perspective view, respectively, illustrate longitudinal sections of a suppressor 100, in accordance with an embodiment of the present disclosure. Broken lines and arrows in these figures represent example gas flow paths. Note, however, that the arrows are for illustration only and may not represent all gas flows and may not accurately represent changes in gas flow patterns that may occur throughout the firing cycle, as will be appreciated.

The suppressor 100 defines an inner chamber 108 radially inside of the baffle stack wall 125 and an outer chamber 109 between the baffle stack wall 125 and the outer housing 102. As high pressure gases enter the suppressor 100, the gases expand initially into the blast chamber 112. A first portion of gases flows into the inner chamber 108 via the central opening 136 of the first baffle 122*a*. A second portion of gases passes into the outer chamber 109 by flowing around the baffle structure 126 of the first baffle 122*a* and through openings in the diffusor cone 114. After entering the outer chamber 109, gases generally continue to flow towards the distal end portion 14 where these gases vent through the flash hider 200.

A gas port 127 in the baffle wall segment 124 of the first baffle 122*a* (or blast baffle) is positioned to direct gases into the inner chamber 108 in a direction crossing the bore axis 10. The central opening 136 of the second baffle structure 126*b* is stepped to direct gases across the bore axis 10 in the same general direction as the gas port 127, which is downward in this example. Similarly, conduits 144 around baffle structures 126 direct gases in the radially outer portion of the inner chamber 108 to flow across the bore axis 10 through first through openings 142. Some of the gases in the inner chamber 108 pass through gas ports 128 to the outer chamber 109.

For gases flowing through the inner chamber 108, individual features of the baffle 122 can be included to promote flow in a direction across the bore axis 10 and disrupt gas flow along the bore axis 10. In combination, these features promote one or more sinuous or non-linear gas flow paths through the inner chamber 108. These features include the gas port 127 in the first baffle 122*a* that directs gases across the bore axis 10, the stepped profile of the central opening 136 that causes gases to flow through the central opening 136 in a direction transverse to the bore axis 10, and a conduit 144 and first through opening 142 in the baffle cone 126.

The suppressor 100 can also include features that result in low backpressure, which reduces the flow of gases back through the barrel and receiver during the firing cycle. One such feature is a second through opening 146 in the baffle structure 126 that allows gases to pass from one baffle to the next via conduit 144. Another feature is a gas port 128 positioned to draw gases into the outer chamber 109 from the radially outer portion of the inner chamber 108, rather than stalling in the corner between the baffle structure 126 and the baffle stack wall 125. Yet another feature is the outer chamber 109, in which a large portion of total combustion gases volume flows with generally less resistance than the more tortuous flow path through the inner chamber 108. Further, a flash hider 200 is configured to vent gases from the outer chamber 109 either directly or after first entering the inner chamber 108 with less flow restriction than traditional baffle suppressors featuring a central opening only. Examples of a flash hider 200 are discussed below.

For gases in the outer chamber 109, vanes 130' in diverging and converging pairs increase turbulence and force a tortuous flow path to the distal end portion 14. Collisions with the vanes 130' and other flow-directing structures 130 result in energy loss and transfer of heat from the gases. As noted above, diverging vanes 130' create a localized region of lower pressure that draws gases out of the inner chamber 108 via gas ports 128. Conduits 144 on opposite sides of the inner chamber 108 are positioned sequentially to amplify a sinuous or alternating gas flow path through the inner chamber 108. The conduits 144 direct gases through the crossflow opening 142 in the baffle structure 126 and across the bore axis 10.

Baffles 122 in the baffle stack 120 need not have the same features in all embodiments. For example, only the first baffle 122*a* defines a gas port 127 and gas ports 128 may be present in alternating baffles 122. Additionally, adjacent baffles can be rotated 180° or some other amount to promote a sinuous and/or swirling gas flow. Numerous variations and embodiments will be apparent in light of the present disclosure.

Figure 10A:
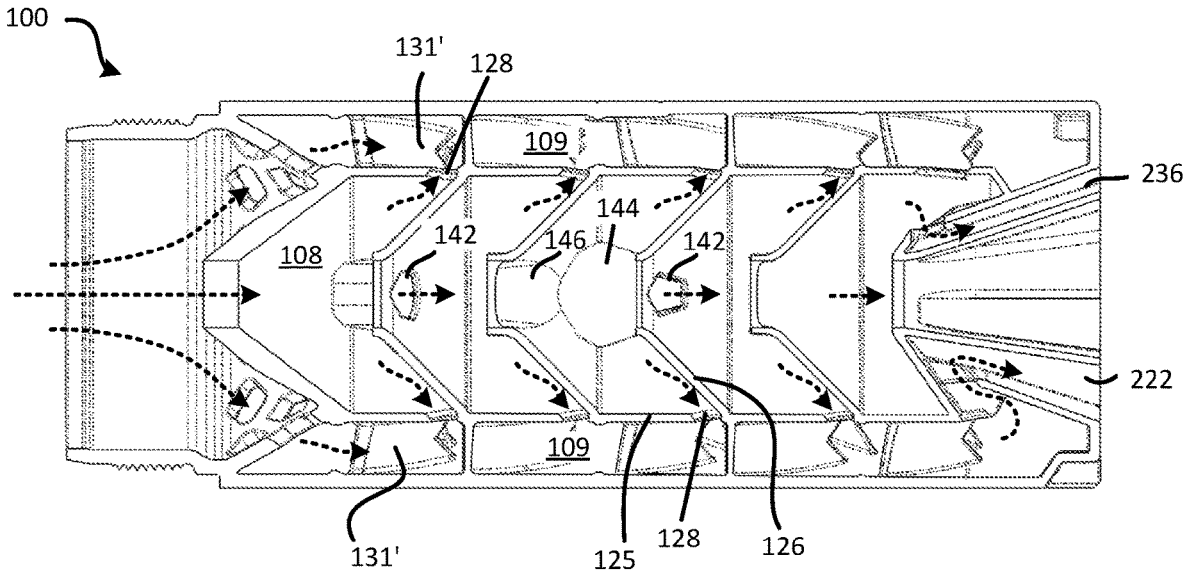
FIG. 10A illustrates a top sectional view of a suppressor, in accordance with an embodiment of the present disclosure.
Figure 10B:
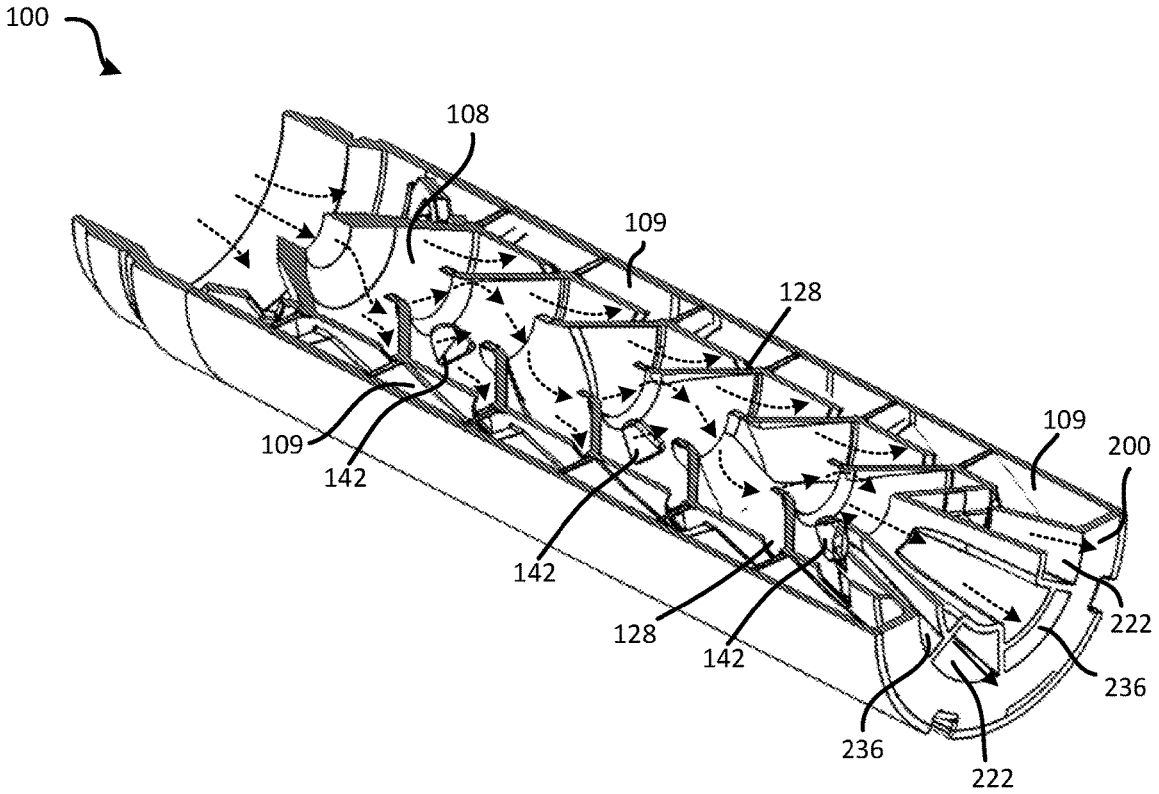
FIG. 10B illustrates a front perspective view of the suppressor section of FIG. 10A, in accordance with an embodiment of the present disclosure.

FIG. 10A illustrates a top sectional view of the suppressor 100 of FIG. 8 and FIG. 10B shows a front perspective view of the section shown in FIG. 10A, where the section is taken 90° to that of FIGS. 8-9, in accordance with an embodiment of the present disclosure. Gases flowing through the inner chamber 108 can pass through gas ports 128 to the outer chamber 109. In this example each gas port 128 is positioned in the corner between a baffle structure 126 and baffle stack wall 125. Such placement avoids or reduces stalled gas flow in these areas. To facilitate gas flow from the inner chamber 108 to the outer chamber 109, rather than in the reverse direction, gas ports 128 can be positioned between diverging vanes 130' which create a localized region of low pressure. First through openings 142 and second through openings 146 in baffle structures 126 are also shown along with conduits 144. In this example, gases in the inner chamber 108 can exit the suppressor through additional second outer volumes 236 of the flash hider 200, and gases in the outer chamber 109 can exit the suppressor through radially outer volumes 222.

Figure 11A:
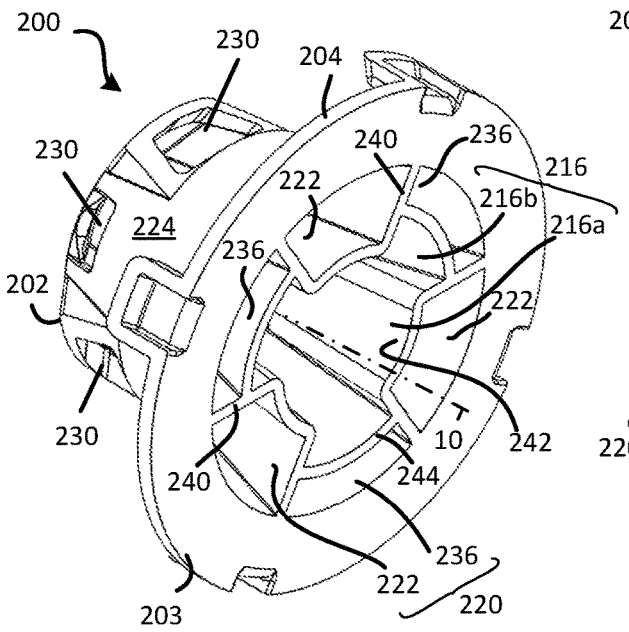
FIGS. 11A-11D illustrate a front perspective view, a front view, a rear perspective view, and a side cross-sectional view, respectively, of an end cap configured as a flash hider, in accordance with an embodiment of the present disclosure.
Figure 11B:
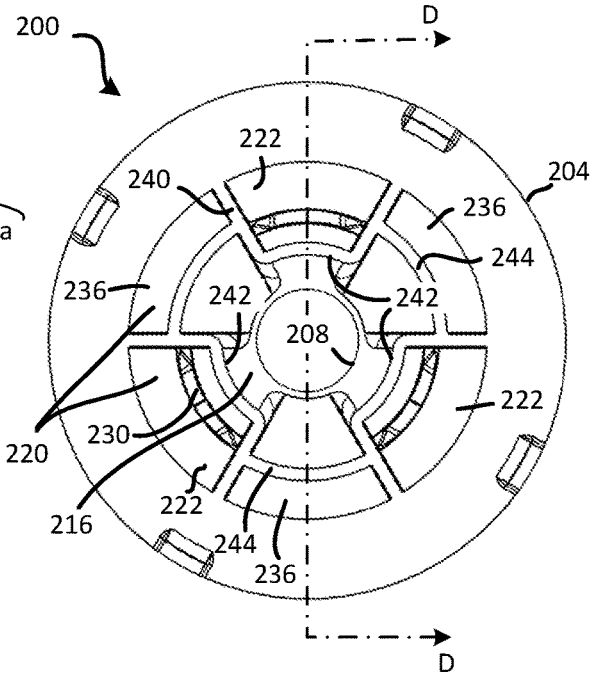

Referring now to FIGS. 11A-11D, a flash hider 200 is shown in a top and front perspective view, a front view, a rear perspective view, and a side cross-sectional view as viewed along line D-D of FIG. 11B, respectively, in accordance with an embodiment of the present disclosure. In FIG. 10D, part of the outer housing 102 is shown.

The flash hider 200 extends along the bore axis 10 from a proximal end 202 to a distal end 203. An outer wall 224 extends between and connects the proximal end 202 and distal end 203. The proximal end 202 defines a central opening 208 for passage of a projectile and gases. Ports 230 in the outer wall 224 adjacent the proximal end 202 provide an alternate entry point for gases to enter the flash hider 200. In this example, the flash hider 200 includes a flange or distal wall 204 extending radially outward from the distal end 203 of the outer wall 224, in effect providing an endcap as part of the flash hider 200. In some embodiments, the rim 206 of the endcap or distal wall 204 can be connected to the outer housing 102, such as by welding, a frictional fit, or a threaded connection.

The outer wall 224 defines an expanding volume as it extends distally. The outer wall 224 directs propellant gases away from the bore axis 10 and limits the expansion of the propellant gases. In some embodiments, the outer wall 224 has a frustoconical shape that defines an outer wall angle A with respect to the bore axis 10. Examples of acceptable values for the outer wall angle A include 10-45°, including 15°-20°, and 16-18°. In other embodiments, the outer wall 224 can have other cross-sectional shapes, such as a square, rectangle, hexagon, or other polygonal or elliptical shape. The outer wall 224 (or portions thereof) can have a linear or non-linear taper from the distal end 203 to the proximal end 202. Examples of a non-linear taper include a curved (e.g., elliptical or parabolic) or a stepped profile.

The volume of the flash hider 200 within the outer wall 224 includes a first flash hider portion 216 and a second flash hider portion 220. The first flash hider portion 216 vents a first portion of gases that enter the flash hider 200 through the central opening 208. For example, the first flash hider portion 216 vents gases flowing through the inner chamber 108 along the bore axis 10. The second flash hider portion 220 vents a second portion of gases that enter the flash hider 200 through one or more ports 230 in the outer wall 224 of the flash hider 200. For example, the second flash hider portion 220 vents gases from the outer chamber 109 and/or gases in the radially outer portion of the inner chamber 108. In this example, the second flash hider portion 220 vents gases from both the outer chamber 109 and the inner chamber 108 via radially outer volumes 222.

In some embodiments, the first flash hider portion 216 includes an inner volume 216*a* with a conical shape that expands distally from the central opening 208. As shown in FIG. 11B, for example, the inner volume 216*a* includes the frustoconical volume circumscribed by and defined in part by the radially inner faces 242 of the flow partitions 240. The first flash hider portion 216 also includes first outer volumes 216*b* positioned radially outside of and continuous with the inner volume 216*a*. In this example, each first outer volume 216*b* is positioned radially between the inner volume 216*a* and the circumferential wall 244, where each first outer volume 216*b* is also located circumferentially between adjacent flow partitions 240 of the second flash hider portion 220. The first portion of gases entering through the central opening 208 can expand along the inner volume 216*a* and can further expand into the first outer volumes 216*b*.

In one example, the inner volume 216*a* has a frustoconical geometry extending along the bore axis 10. In some such embodiments, the inner faces 242 of the flow partitions 240 have an inner wall angle B (shown in FIG. 11D) with the bore axis 10 from 4-15°, including 5-8°, or 6-7°, for example. Such a value for the inner wall angle B has been found to slow down propellant gases exiting to the environment as well as to reduce the amount of hot propellant gases that mix with ambient air/oxygen. Accordingly, and without being constrained to any particular theory, it is believed that such an inner wall angle B permits adequate gas expansion yet also desirably reduces the size of a "Mach disk" or "flow diamond"—appearing as an orange or red flash—as propellant gases transition from supersonic to subsonic flow.

The second flash hider portion 220 includes a plurality of radially outer volumes 222 that are interspersed circumferentially with the first outer volumes 216*b* of the first flash hider portion 216. The radially outer volumes 222 are defined within flow partitions 240 connected to the outer wall 224. In this example, each flow partition 240 connects to the proximal end 202 of the flash hider 200 adjacent the central opening 208 and extends forward to the distal end 203. Accordingly, each flow partition 240 isolates one of the radially outer volumes 222 from the first flash hider portion 216 and in part defines the inner volume 216*a* of the first flash hider portion 216. In this example, three radially outer volumes 222 generally resemble sectors of an annular region located between the frustoconical inner volume 216*a* and the outer wall 224. The second flash hider portion 220 can have other numbers of radially outer volumes 222, such as two, four, or some other number. In one example, each flow partition 240 generally has a U shape as viewed from the distal end 203. The flow partitions 240 can be rectangular, rounded, or have some other geometry. The radially outer volumes 222 are distributed and spaced circumferentially about the bore axis 10 and are located radially outside of the inner volume 216*a* of the first flash hider portion 216. In some embodiments, all flow partitions 240 have the same dimensions and are evenly distributed about the bore axis 10, although this is not required.

The second flash hider portion 220 optionally also includes additional second outer volumes 236 that are positioned laterally between adjacent flow partitions 240 and radially between the outer wall 224 and a circumferential wall 244 between adjacent flow partitions 240. In this example, each additional second outer volume 236 is located radially outside of the first outer volume 216*b* of the first flash hider portion 216, so that a first outer volume 216*b* and an additional second outer volume 236 share a region between adjacent flow partitions 240 and are separated by the circumferential wall 244. The additional second outer volumes 236 are shown as having a reduced cross-sectional area compared to the radially outer volumes 222, but this is not required. For example, each additional second outer volume 236 can have a reduced radial dimension, but a greater circumferential dimension compared to these dimensions of the radially outer volumes 222, resulting in a cross-sectional area that is about equal to or even greater than that of the radially outer volume 222.

Gases can enter the radially outer volumes 222 of the second flash hider portion 220 from the inner chamber 108 via ports 230 in the proximal portion of the outer wall 224, in some embodiments. When the flash hider 200 is part of a suppressor assembly, some or all of the gases flowing through the suppressor along a radially outer flow path can enter the second flash hider portion 220 through ports 230. Absent any openings through the flow partition 240, and absent any gases entering the second flash hider portion 220 through the distal end 203, gases entering the central opening 208 are isolated from and cannot flow through the radially outer volumes 222 of the second flash hider portion 220.

One advantage of venting radially outer volumes or off-axis flow of the suppressor 100 is to reduce the pressure of the gases flowing along the bore axis 10. In doing so, flash can be reduced. Venting through the second flash hider portion 220 also can reduce the pressure in the suppressor 100 and therefore reduce the back flow of gases into the firearm's chamber, such as when the suppressor 100 is used with semi-automatic or automatic rifles. Further, isolating the gas flow through the second flash hider portion 220 from the first flash hider portion 216 can inhibit mixing and turbulence of gases exiting the flash hider 200, and therefore reduce the visible signature of the firearm, as will be appreciated.

Figure 11C:
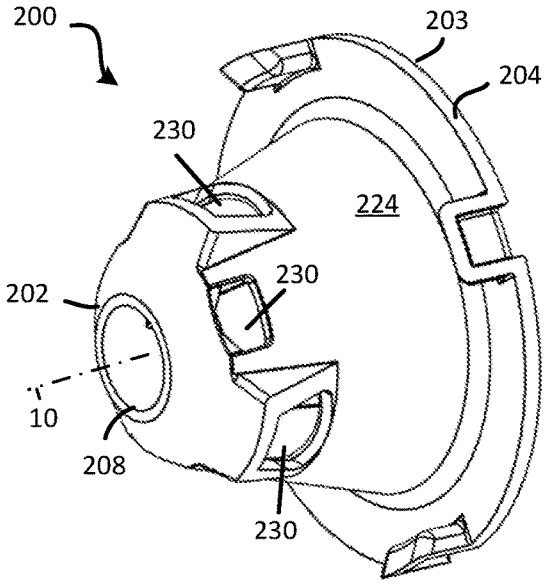
Figure 11D:
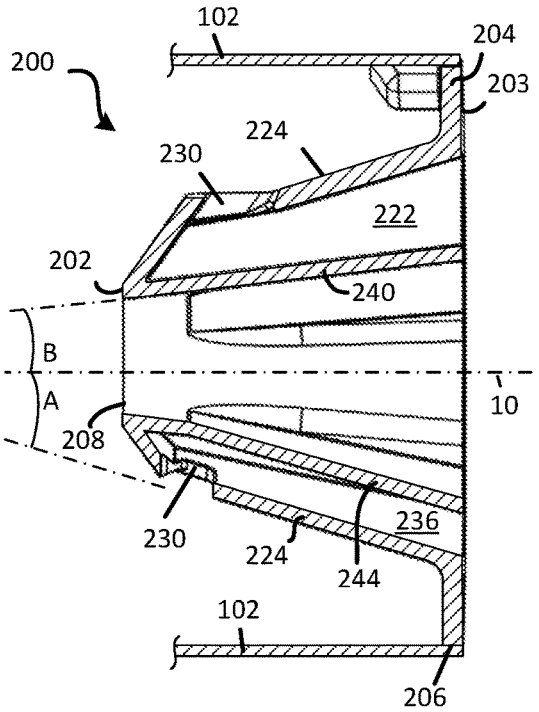

In some embodiments, ports 230 into radially outer volumes 222 are oriented generally parallel to the bore axis 10 so as to prevent a line-of-sight into the suppressor 100 through radially outer volumes 222. In one such embodiment, the proximal end portion of the outer wall 224 protrudes radially outward at these ports 230 so as to preclude a line of sight into the suppressor 100. As shown in FIGS. 11B-11C, for example, these ports 230 are generally oriented parallel to the bore axis 10 due to a radial expansion of the outer wall 224.

Figure 12A:
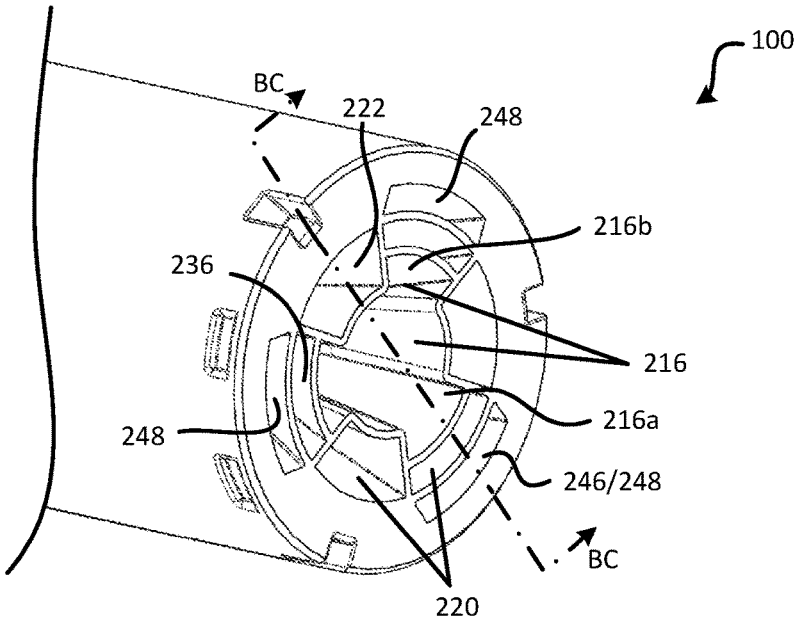
FIG. 12A illustrates a distal end portion of a suppressor with an endcap configured as a flash hider, in accordance with another embodiment of the present disclosure.
Figure 12B:
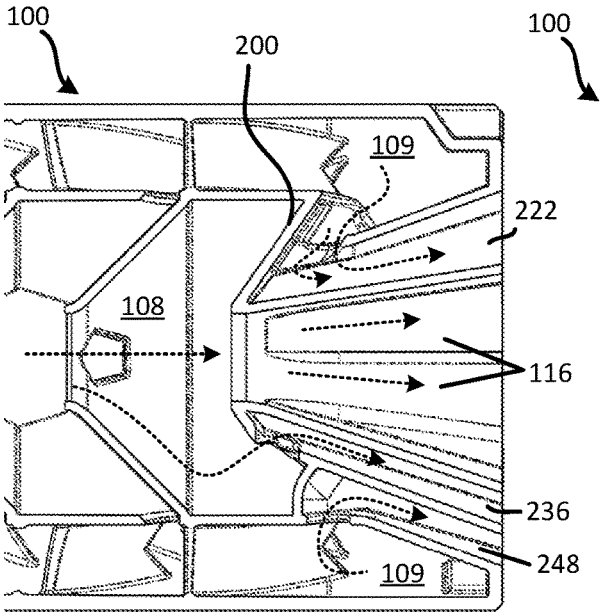
FIGS. 12B and 12C illustrate a side view and a front perspective view, respectively, and show a longitudinal section as viewed along line BC-BC of FIG. 12A, in accordance with an embodiment of the present disclosure.
Figure 12C:
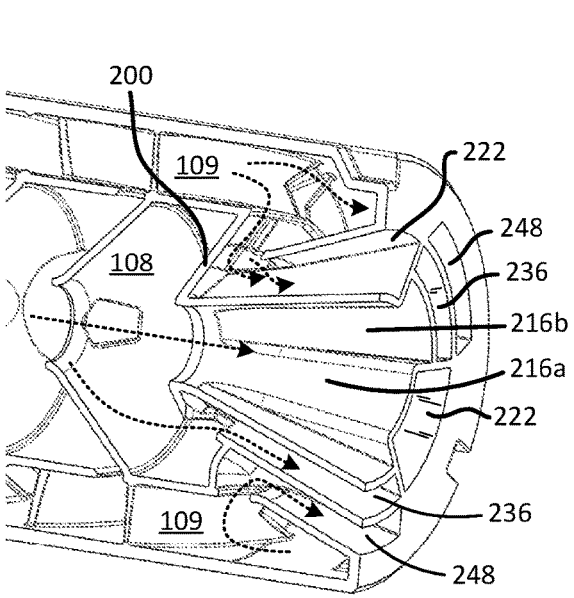

FIGS. 12A-12C illustrate a suppressor 100 with a flash hider 200 in accordance with another embodiment of the present disclosure. FIG. 12A is a front perspective view of a distal end portion of a suppressor 100. FIG. 12B is a side view of a section as viewed along line BC-BC of FIG. 12A, and FIG. 12C is a front perspective view of the section as viewed along line BC-BC.

In this embodiment, the flash hider includes a first flash hider portion 216 that includes the inner volume 216*a* and first outer volumes 216*b*, similar to the embodiment discussed above with reference to FIGS. 11A-11D. A second flash hider portion 220 includes radially outer volumes 222 and additional second outer volumes 236, similar to as discussed above. Compared to the embodiment of FIGS. 11A-11D, this embodiment also includes a third flash hider portion 246 with vents 248 positioned radially outside of each additional second outer volume 236. Gases in the outer chamber 109 can exit the flash hider 200 directly through vents 248. Gases in the outer chamber 109 can also exit the suppressor directly through radially outer volumes 222. Unlike the embodiment of FIGS. 11A-11D, the cross-sectional view of FIG. 12C illustrates gas flow paths for gases in the outer chamber 109 to exit the suppressor 100 via vents 248 and radially outer volumes 222, where the first flash hider portion 216 and additional second outer volumes 236 vent gases from the inner chamber 108. Gases from the inner chamber 108 can also exit the suppressor 100 via radially outer volumes 222, such as shown in FIGS. 12B-12C.

Figure 13A:
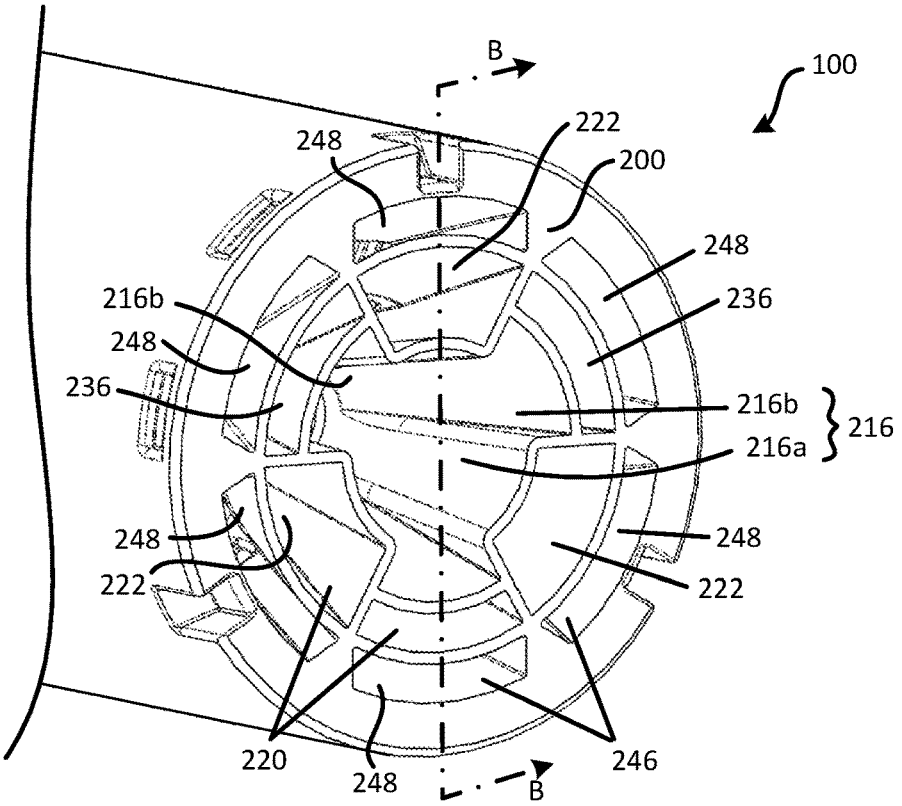
FIG. 13A is a front perspective view of a distal end portion of a suppressor with an endcap configured as a flash hider, in accordance with another embodiment of the present disclosure.
Figure 13B:
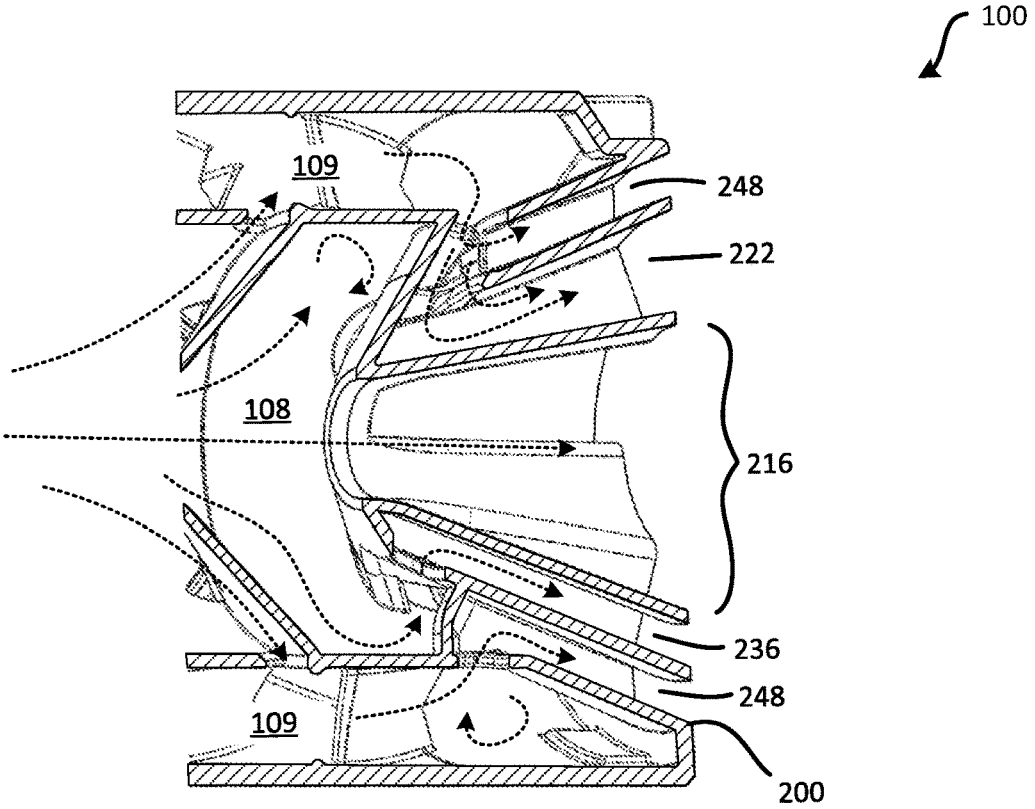
FIG. 13B is a side, sectional view of the distal end portion of the suppressor as viewed along line B-B of FIG. 13A, in accordance with an embodiment of the present disclosure.

FIGS. 13A and 13B illustrate part of a suppressor 100 with a flash hider 200, in accordance with another embodiment of the present disclosure. FIG. 13A is a front perspective view showing a distal end portion of a suppressor 100 with the flash hider 200. FIG. 13B is a side view showing a section as viewed along line B-B of FIG. 13A.

In this embodiment, the flash hider 200 includes a first flash hider portion 216 that includes the inner volume 216*a* and first outer volumes 216*b*, similar to the embodiment discussed above with reference to FIGS. 11A-11D. A second flash hider portion 220 is radially outside of the first flash hider portion 216 and includes radially outer volumes 222 positioned radially outside of the inner volume 216*a*, and additional second outer volumes 236 positioned radially outside of first outer volumes 216*b* of the first flash hider portion 216. This embodiment further includes third flash hider portion 246 radially outside of the second flash hider portion 220. The third flash hider portion 246 includes vents 248 positioned radially outside of some or all of the additional second outer volumes 236 and radially outside of some or all of the radially outer volumes 222. In this example, the third flash hider portion 246 includes six vents 248 distributed circumferentially.

The first flash hider portion 216 vents gases from the inner chamber 108 and that enter the flash hider 200 through the central opening 208. In this example, the second flash hider portion 220 vents gasses flowing directly from the inner chamber 108 and directly from the outer chamber 109. Gases in the inner chamber 108 can exit the flash hider 200 through the additional second outer volumes 236 or through radially outer volumes 222 via ports 230. Gases in the outer chamber 109 can exit the flash hider 200 directly through radially outer volumes 222. Thus, the second flash hider portion 220 vents gases from both the inner chamber 108 and outer chamber 109 in this example.

In other embodiments, the second flash hider portion 220 can be configured to directly communicate only with the inner chamber 108 or only with the outer chamber 109. For example, radially outer volumes 222 can communicate directly with the inner chamber 108 via ports 230, such as shown in FIGS. 12B-12C, so that the second flash hider portion 220 vents gases directly from the inner chamber 108 and vents 248 vent gases directly from the outer chamber 109.

Gases in the outer chamber 109 can exit the flash hider 200 directly through vents 248. Gases in the outer chamber 109 can also exit the suppressor directly through radially outer volumes 222. The cross-sectional view of FIG. 12C illustrates gas flow paths for gases to exit the suppressor 100 from the outer chamber 109 via vents 248 and radially outer volumes 222, where the first flash hider portion 216 and additional second outer volumes 236 vent gases from the inner chamber 108.

As will be appreciated in light of the present disclosure, a suppressor assembly 100 provides multiple gas flow paths that can be configured to reduce the audible and visible signature of the firearm. As discussed above, combustion gases can be divided into two volumes of gas that are largely separated from each other to more evenly and more completely fill the entire volume of the suppressor 100. These gas volumes pass through the corresponding inner and outer chambers (with some mixing therebetween) before exiting the suppressor 100 through a flash hider 200. Flow of part of the gases through the outer chamber can significantly reduce the back flow of pressurized gases into the firearm. This mixing of gases between the inner chamber 108 and outer chamber 109 allows for better filling of the chambers by the combustion gases, longer flow paths, increased gas turbulence, better cooling, and a faster reduction in total energy of the gases. These in turn, can produce the benefits described above.

It will be appreciated that the gases flowing through the inner chamber 108 are slowed and/or cooled by the operation of the baffles 122, which additionally induce localized turbulence and energy dissipation, thus reducing (or "suppressing") the sound and/or flash of expanding gases. For example, as the gases collide with baffles 122 and other surfaces in the suppressor, the gases converge and then expand again in a different direction, for example. The various collisions and changes in velocity (direction and/or speed) result in localized turbulence, an elongated flow path, and heat and energy losses from the gases, thereby reducing the audible and visual signature of the rifle.

Further Example Embodiments

The following examples pertain to further embodiments, from which numerous permutations and configurations will be apparent.

Example 1 is a suppressor comprising a hollow tubular housing extending along a bore axis from a proximal end to a distal end. A baffle stack within the hollow tubular housing extends along the bore axis from a proximal baffle stack end to a distal baffle stack end. The baffle stack has a tubular baffle wall with a plurality of cone-like baffle structures connected to an inside of the baffle wall and tapering in a rearward direction to a central opening on the bore axis. The suppressor defines an inner volume inside of the tubular baffle wall and an outer volume between the tubular baffle wall and the hollow tubular housing. Flow-directing structures in the outer volume include pairs of diverging vanes and pairs of converging vanes with respect to gases flowing distally through the suppressor. A conduit wall extends between and connects adjacent baffle structures, wherein the conduit wall defines a gas flow pathway in a radially outer portion of the inner volume. The gas flow pathway passes around a proximal one of the adjacent baffle structures and through an opening defined in a distal one of the adjacent baffle structures.

Example 2 includes the subject matter of Example 1, where the tubular baffle wall defines an initial gas port adjacent the proximal baffle stack end.

Example 3 includes the subject matter of Example 2, where the initial gas port is positioned between a pair of converging vanes.

Example 4 includes the subject matter of any one of Examples 1-3 and further comprises a diffusor cone in a proximal end portion of the suppressor, the diffusor cone tapering in a distal direction from the tubular outer housing to the baffle stack and defining a plurality of openings, where the gas port is positioned adjacent a distal end portion of the diffusor cone.

Example 5 includes the subject matter of any one of Example 2-4, where the initial gas port is configured to direct gases from the outer volume to the inner volume and through a vent opening in a baffle structure in a proximal end portion of the baffle stack.

Example 6 includes the subject matter of Example 5, where gases passing through the vent opening intersect with gases flowing along the bore axis.

Example 7 includes the subject matter of any one of Examples 1-6, where the suppressor includes two or more conduits with at least one conduit on a first side of the bore axis and at least one conduit on an opposite second side of the bore axis, and where the two or more conduits alternate sequentially between the first side of the bore axis and the second side of the bore axis.

Example 8 includes the subject matter of Example 7, wherein the suppressor includes at least three conduits.

Example 9 includes the subject matter of Examples 7 or 8, wherein the two or more conduits define a sinuous gas flow path through the inner volume.

Example 10 includes the subject matter of Example 9, wherein the sinuous gas flow path crosses the bore axis.

Example 11 includes the subject matter of any one of Examples 1-10, where the central opening of at least some of the baffle structures has a first portion and a second portion, where the first portion is axially offset relative to the second portion.

Example 12 includes the subject matter of Example 11, wherein the first portion is semicircular and the second portion is semicircular, so that as viewed along the central axis the first and second portions in combination define a circular central opening.

Example 13 includes the subject matter of any one of Examples 1-12, where the pairs of converging vanes and the pairs of diverging vanes generally define a zig-zag pattern around an outside of the tubular baffle wall, the pattern including circumferential rows of vanes and axial columns of vanes, wherein adjacent vanes in the circumferential rows have an alternating orientation with respect to the bore axis.

Example 14 includes the subject matter of Example 13, where individual vanes of the pairs of converging vanes and pairs of diverging vanes have a helical shape.

Example 15 includes the subject matter of Example 13 or 14, wherein vertices of pairs of converging vanes are aligned along first axes generally parallel to the bore axis, and wherein vertices of pairs of diverging vanes are aligned along second axes generally along to the bore axis, the first axes interspersed with the second axes around the baffle stack.

Example 16 includes the subject matter of any one of Examples 1-15 and further comprises a flash hider in fluid communication with the baffle stack and connected to the distal end of the hollow tubular housing.

Example 17 includes the subject matter of Example 16, wherein the flash hider includes a first flash hider portion configured to vent a first portion of gases from the inner volume and a second flash hider portion configured to vent a second portion of gases from the outer volume and from the inner volume.

Example 18 includes the subject matter of Example 17, wherein the flash hider further defines a third flash hider portion configured to vent gases directly from the outer volume.

Example 19 includes the subject matter of Example 18, wherein the second flash hider portion is radially outside of the first flash hider portion and the third flash hider portion is radially outside of the second flash hider portion.

Example 20 is a suppressor that includes a baffle stack with a cylindrical wall around an inner volume and extending along a central axis. The baffle stack includes a plurality of cone-like baffle structures each of which is connected to the cylindrical wall and tapers rearwardly to a central opening, where at least some of the baffle structures define a vent opening between the central opening and the baffle stack wall. An outer housing around the baffle stack has an inner surface spaced from and confronting the cylindrical wall, where the suppressor defines an outer volume between the cylindrical wall of the baffle stack and the outer housing. Flow-directing features are in the outer volume. A diffusor cone is in a proximal end portion of the suppressor, the diffusor cone tapering in a distal direction between the outer housing and the baffle stack and defining a plurality of openings. A conduit wall extends between and connects adjacent baffle structures of the baffle stack, wherein the conduit wall defines a gas flow pathway in a radially outer portion of the inner volume. The gas flow pathway passes around a proximal cone of the adjacent baffle structures and through the vent opening defined in a distal cone of the adjacent baffle structures. An end cap is connected to a distal end of the outer housing, the end cap defining a central opening aligned with the central axis.

Example 21 includes the subject matter of Example 20, where a proximal end portion of the cylindrical wall of the baffle stack defines an initial gas port between a pair of converging vanes, the initial gas port in direct fluid communication with a vent opening in one of the plurality of baffle structures.

Example 22 includes the subject matter of Example 20 or 21, where the central opening of at least some baffle structures of the plurality of baffle structures defines a step as viewed from a side of the suppressor, such that a first portion of the central opening is spaced distally along the central axis from a second portion of the central opening.

Example 23 includes the subject matter of any of Examples 20-22, wherein the end cap is configured as a flash hider, the flash hider including a first flash hider portion configured to vent a first portion of gases directly from the inner volume and a second flash hider portion configured to vent gases from both the inner volume and the outer volume.

Example 24 includes the subject matter of Example 23, wherein the flash hider further defines a third flash hider portion configured to vent gases directly from the outer volume.

Example 25 is a suppressor baffle comprising an annular baffle wall extending axially along a bore axis from a first end to a second end; a baffle structure connected to the tubular baffle wall and extending along the bore axis away from the tubular baffle wall and defining a central opening aligned with the bore axis. Flow-directing structures are on an outside of the tubular baffle wall and include vanes oriented transversely to the bore axis. The vanes include converging vanes and diverging vanes, wherein each pair of converging vanes and pair of diverging vanes generally defines a vertex and an open mouth opposite the vertex. The baffle structure defines a through-opening between the central opening and the tubular baffle wall. A conduit around the through opening extends rearwardly and is configured to engage a baffle structure of a proximally located suppressor baffle. When two or more suppressor baffles are assembled together, the conduit defines a gas flow path around a rearward baffle structure and through the through-opening of the forward baffle structure.

Example 26 includes the subject matter of any of Example 25, wherein the vertex is an open vertex permitting gas flow through the vertex.

Example 27 includes the subject matter of Example 25 or 26, wherein individual pairs of diverging vanes and individual pairs of converging vanes direct gases along a helical gas flow path.

Example 28 includes the subject matter of any of Examples 25-27, wherein the tubular baffle wall is cylindrical.

Example 29 includes the subject matter of any of Examples 1-28, wherein the tubular baffle wall defines one or more openings adjacent an intersection between the baffle structure and the tubular baffle wall.

Example 30 includes the subject matter of Example 29, wherein each of the one or more openings is positioned between a pair of diverging vanes on the outside of the tubular baffle wall.

Example 31 includes the subject matter of any one of Examples 25-30, wherein the central opening has a stepped shape as viewed from the side, the stepped shape defining a first portion of the central opening that is axially offset from a second portion of the central opening.

Example 32 includes the subject matter of Example 31, wherein the first portion and second portion of the central opening together define a circular shape as viewed along the central axis.

Example 33 includes the subject matter of any of Examples 25-32, wherein the vanes are arranged in a zig-zag pattern around a circumference of the tubular baffle wall.

Example 34 includes the subject matter of any of Examples 25-33, wherein each of the vanes follows a helical path.

Example 35 is a suppressor baffle stack including a plurality of suppressor baffles as disclosed in Examples 25-34.

Example 36 includes the subject matter of Example 35, wherein the baffle stack includes at least three suppressor baffles.

Example 37 is a suppressor comprising the baffle stack of Example 36.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A suppressor comprising:

a hollow tubular housing extending along a bore axis from a proximal end to a distal end;

a baffle stack within the hollow tubular housing and extending along the bore axis from a proximal baffle stack end to a distal baffle stack end, the baffle stack comprising a tubular baffle wall with a plurality of baffle structures connected to an inside of the tubular baffle wall, individual baffle structures of the plurality of baffle structures tapering proximally to a central opening on the bore axis, wherein the suppressor defines an inner volume inside of the tubular baffle wall, and an outer volume between the tubular baffle wall and the hollow tubular housing;

flow-directing structures in the outer volume, the flow-directing structures including pairs of diverging vanes and pairs of converging vanes with respect to gases flowing distally through the suppressor; and a conduit wall extending between and connecting adjacent baffle structures of the plurality of baffle structures, wherein the conduit wall defines a gas flow pathway in a radially outer portion of the inner volume, the gas flow pathway passing around a proximal one of the adjacent baffle structures and through an opening defined in a distal one of the adjacent baffle structures.

2. The suppressor of claim 1, wherein the tubular baffle wall defines an initial gas port adjacent the proximal baffle stack end.

3. The suppressor of claim 2, wherein the initial gas port is positioned between one of the pairs of converging vanes.

4. The suppressor of claim 3, further comprising a diffusor cone in a proximal end portion of the suppressor, the diffusor cone tapering in a distal direction from the tubular housing to the baffle stack and defining a plurality of openings, wherein the gas port is positioned adjacent a distal end portion of the diffusor cone.

5. The suppressor of claim 3, wherein the initial gas port is configured to direct gases from the outer volume to the inner volume and through a vent opening in one of the baffle structures at the proximal baffle stack end of the baffle stack.

6. The suppressor of claim 1, further comprising two or more conduits that include at least one conduit on a first side of the bore axis and at least one conduit on an opposite second side of the bore axis, and wherein the two or more conduits alternate sequentially between the first side of the bore axis and the opposite second side of the bore axis.

7. The suppressor of claim 6, further comprising at least two conduits.

8. The suppressor of claim 1, wherein the central opening of at least some of the baffle structures has a first portion and a second portion, the first portion axially offset from the second portion.

9. The suppressor of claim 8, wherein the first portion and the second portion each have a semicircular shape that combine to define the central opening of circular shape as viewed along the bore axis.

10. The suppressor of claim 1, wherein the pairs of converging vanes and the pairs of diverging vanes define a zig-zag pattern around an outside of the tubular baffle wall.

11. The suppressor of claim 10, wherein individual vanes of the pairs of converging vanes and pairs of diverging vanes have a helical shape.

12. The suppressor of claim 1 further comprising:

a flash hider in fluid communication with the baffle stack and connected to the distal end of the hollow tubular housing.

13. The suppressor of claim 12, wherein the flash hider includes a first flash hider portion configured to vent a first portion of gases from the inner volume and a second flash hider portion configured to vent gases from the outer volume and from the inner volume.

14. The suppressor of claim 13, wherein the flash hider further defines a third flash hider portion configured to vent gases directly from the outer volume.

15. The suppressor of claim 14, wherein the second flash hider portion is radially outside of the first flash hider portion and the third flash hider portion is radially outside of the second flash hider portion.

16. A suppressor comprising:

a baffle stack with a cylindrical wall around an inner volume and extending along a central axis, the baffle stack including a plurality of baffle structures connected to the cylindrical wall and tapering rearwardly to a central opening, wherein at least some of the baffle structures define a vent opening;

an outer housing around the baffle stack, the outer housing having an inner surface spaced from and confronting the cylindrical wall, wherein the suppressor defines an outer volume between the cylindrical wall of the baffle stack and the outer housing;

flow-directing features in the outer volume;

a diffusor cone in a proximal end portion of the suppressor, the diffusor cone tapering in a distal direction between the outer housing and the baffle stack and defining a plurality of openings;

a conduit wall extending between and connecting adjacent baffle structures of the plurality of baffle structures, wherein the conduit wall defines a gas flow pathway in a radially outer portion of the inner volume, the gas flow pathway passing around a proximal cone of the adjacent baffle structures and through the vent opening defined in a distal cone of the adjacent baffle structures; and an end cap connected to a distal end of the outer housing, the end cap defining a central opening aligned with the central axis.

17. The suppressor of claim 16, wherein a proximal end portion of the cylindrical wall of the baffle stack defines a gas port between a pair of converging vanes of the flow-directing features, the gas port in direct fluid communication with the vent opening in one of the plurality of baffle structures.

18. The suppressor of claim 16, wherein the central opening of at least some baffle structures of the plurality of baffle structures defines a step as viewed from a side of the suppressor, such that a first portion of the central opening is spaced distally along the central axis from a second portion of the central opening.

19. The suppressor of claim 16, wherein the end cap is configured as a flash hider, the flash hider including a first flash hider portion configured to vent a first portion of gases directly from the inner volume and a second flash hider portion configured to vent gases from the outer volume and from the inner volume.

20. The suppressor of claim 19, wherein the flash hider further defines a third flash hider portion configured to vent gases directly from the outer volume.

* * * * *